US009157345B2

(12) United States Patent
Kinouchi et al.

(10) Patent No.: US 9,157,345 B2
(45) Date of Patent: Oct. 13, 2015

(54) VALVE CONTROL APPARATUS

(71) Applicant: DENSO CORPORATION, Kariya, Aichi-pref. (JP)

(72) Inventors: Soichi Kinouchi, Kariya (JP); Nadir Syed, Takahama (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/321,043

(22) Filed: Jul. 1, 2014

(65) Prior Publication Data

US 2015/0007788 A1 Jan. 8, 2015

(30) Foreign Application Priority Data

Jul. 2, 2013 (JP) ..... 2013-139247

(51) Int. Cl.
*F01L 1/34* (2006.01)
*F01L 1/344* (2006.01)

(52) U.S. Cl.
CPC ..... *F01L 1/3442* (2013.01); *F01L 2001/34453* (2013.01); *F01L 2001/34463* (2013.01); *F01L 2001/34466* (2013.01)

(58) Field of Classification Search
CPC ..... F01L 1/3442; F01L 2001/34453; F01L 2001/34463; F01L 2001/34466
USPC ..... 123/90.15, 90.17
See application file for complete search history.

(56) References Cited

U.S. PATENT DOCUMENTS

| | | | | |
|---|---|---|---|---|
| 7,311,069 | B2 * | 12/2007 | Kobayashi et al. | 123/90.17 |
| 2002/0139332 | A1 | 10/2002 | Takenaka | |
| 2005/0166877 | A1 | 8/2005 | Suga et al. | |

FOREIGN PATENT DOCUMENTS

| | | |
|---|---|---|
| JP | 4-21732 | 2/1992 |
| JP | 2002-21515 | 1/2002 |
| JP | 4161356 | 8/2008 |
| JP | 2013-133802 | 7/2013 |
| JP | 2013-133803 | 7/2013 |
| JP | 2013-142348 | 7/2013 |

OTHER PUBLICATIONS

Office Action (3 pages) dated Jun. 23, 2015, issued in corresponding Japanese Application No. 2013-139247 and English translation (4 pages).

* cited by examiner

*Primary Examiner* — Ching Chang
(74) *Attorney, Agent, or Firm* — Nixon & Vanderhye P.C.

(57) ABSTRACT

A forward phase of a forward intermediate rotor is adjusted relative to a crank shaft. A forward stopper mechanism prevents further advance of the forward phase by engaging the forward intermediate rotor at a forward most-advanced phase. A forward locking mechanism locks the forward phase when reaching the forward most-advanced phase at a start time of the engine. A forward biasing member biases the forward intermediate rotor in an advance direction. The backward phase of the intake cam shaft is adjusted relative to a backward intermediate rotor by receiving a cam torque that is biased on average in a retard direction. A backward stopper mechanism prevents further retard of the backward phase by engaging the intake cam shaft at a backward most-retarded phase. A backward locking mechanism locks the backward phase when reaching the backward most-retarded phase at the start time of the engine.

8 Claims, 22 Drawing Sheets

VALVE CONTROL APPARATUS

CROSS REFERENCE TO RELATED APPLICATION

This application is based on and incorporates herein by reference Japanese Patent Application No. 2013-139247 filed on Jul. 2, 2013.

TECHNICAL FIELD

The present disclosure relates to a valve control apparatus that adjusts valve timing of at least an intake valve in an internal combustion engine including an exhaust valve that is opened and closed by rotation of an exhaust cam shaft and the intake valve that is opened and closed by rotation of an intake cam shaft.

BACKGROUND

A patent document 1 (JP 2002-21515 A) discloses a valve control apparatus having an intake cam shaft, an exhaust cam shaft that rotates by receiving a crank torque from a crank shaft of an internal combustion engine, and an intermediate rotor, with which the exhaust cam shaft is provided, rotating relative to the exhaust cam shaft. The rotational phase of the intake cam shaft relative to the crank shaft and the exhaust cam shaft is adjusted when the exhaust cam shaft is rotated in association with the intake cam shaft through the intermediated rotor.

A patent document 2 (JP 4161356 B) discloses a valve control apparatus having an intake cam shaft, a housing rotor that rotates in association with a crank shaft of an internal combustion engine, and an vane rotor, with which the housing rotor is provided, rotating relative to the housing rotor. The rotational phase of the intake cam shaft relative to the crank shaft is adjusted when the housing rotor is rotate in association with the intake cam shaft through the vane rotor. In the valve control apparatus of the patent document 2, the rotational phase of the intake cam shaft relative to the crank shaft is locked at an intermediate phase between the most-retarded phase and the most-advanced phase when the engine is started. According to such an intermediate phase locking mechanism, the startability of the engine can be secured, especially during a cold start under low-temperature environment.

In the valve control apparatus of the patent document 1, the locking mechanism in the valve control apparatus of the patent document 2 can be used. That is, the rotational phase of the intermediate rotor relative to the crank shaft and the exhaust cam shaft can be locked at an intermediate phase by the locking mechanism. However, in a case where the engine is started in a failure state in which the intermediate phase locking is released, such as a state after the engine is stopped in a moment at a phase other than the intermediate phase (i.e., engine stall), the intermediate rotor needs to be rotated to the intermediate phase by the cam torque transmitted to the intermediate rotor from the intake cam shaft. In this case, the intermediate rotor receives the cam torque acting alternately in an advance direction and in a retard direction according to a rotational angle of the crank shaft. Therefore, it may be difficult to keep the intermediated rotor at the intermediate phase, and thus to secure the intermediate phase locking during an engine start, resulting in deteriorating startability of the engine.

SUMMARY

The present disclosure is made in light of the matters described above, and an object of the present disclosure is to provide a valve control apparatus that improves startability of an internal combustion engine.

In a first aspect of the present disclosure, a valve control apparatus adjust valve timing of an internal combustion engine. The engine has an intake valve that is opened and closed by a rotation of an intake cam shaft, and an exhaust valve that is opened and closed by a rotation of an exhaust cam shaft that receives a crank torque from a crank shaft. The valve control apparatus includes a forward phase adjustment unit that has a forward intermediate rotor rotatable relative to the exhaust cam shaft. The forward phase adjustment unit adjusts a forward phase that is a rotational phase of the forward intermediate rotor relative to the crank shaft. A backward phase adjustment unit has a backward intermediate rotor rotatable relative to the intake cam shaft and rotating in association with the forward intermediate rotor. The backward phase adjustment unit adjusts a backward phase that is a rotational phase of the intake cam shaft relative to the backward intermediate rotor. The forward phase adjustment unit includes a forward stopper mechanism that prevents further advance of the forward phase by engaging the forward intermediate rotor at a forward-most advanced phase, which is a furthest-most advanced phase of the forward phase, and a forward locking mechanism that locks the forward phase when reaching the forward-most advanced phase at a start time of the engine. A forward biasing member biases the forward intermediate rotor in an advance direction. The backward phase adjustment unit receives a cam torque from the intake cam shaft that is biased on average in a retard direction. The backward phase adjustment unit includes a backward stopper mechanism that prevents further retard of the backward phase by engaging the intake cam shaft at a backward-most retarded phase, which is a furthest-most retarded phase of the backward phase, and a backward locking mechanism that locks the backward phase when reaching the backward-most retarded phase at the start time of the engine.

According to the first aspect of the present disclosure, at a normal start of the engine, the forward phase that is rotational phase of the forward intermediate rotor rotatable relative to the exhaust cam shaft, which is rotated by receiving the crank torque from the crank shaft, is locked at the forward-most advanced phase through the forward locking mechanism. Along with this, at the normal start of the engine, the backward phase that is rotational phase of the intake cam shaft rotatable relative to the backward intermediate rotor, which is rotated in association with the forward intermediate rotor, is locked at the backward-most retarded phase through the backward locking mechanism. Thus, according to each function of the forward locking mechanism and the backward locking mechanism, the intake cam phase that is a rotational phase of the intake cam shaft relative to the crank shaft is locked at an intake intermediate phase, which is a combined phase of the forward-most advanced phase and the backward-most retarded phase. As a result, startability of the engine by the intermediate phase locking can be improved.

According to the first aspect, under the locking at the forward-most advanced phase by the forward locking mechanism, an engine start in a backward failure state in which the locking at the backward-most retarded phase by the backward locking mechanism is released may be assumed. At the start in the backward failure state, the cam torque that is biased in a retard direction on average acts on the intake cam shaft. As a result, when the backward phase is reached to the backward-most retarded phase by the cam torque to the intake cam shaft, the backward stopper mechanism engages the intake cam shaft and further retard of the backward phase is prevented. Therefore, the backward locking mechanism may easily lock, and thus the intake cam phase becomes a locked state at the intake intermediate phase, as with the normal start, and thus the startability by the intermediate phase locking can be secured.

Further, in the first aspect, an engine start in a forward failure state, in which the locking at the forward-most advanced phase by the forward locking mechanism is released while the locking at the backward-most retarded phase by the backward locking mechanism is maintained, may be assumed. At the start in the forward failure state, the cam torque biased in the retard direction on average acts on the intake cam shaft and the backward intermediate rotor. At this time, the cam torque biased in the retard direction on average is transmitted to the forward intermediated rotor, which rotates in association with the backward intermediate rotor. However, the forward biasing member produces biasing force to bias the forward intermediate rotor in the advance direction against the averaged cam torque. As a result, when the forward phase is reached to the forward-most advanced phase by the biasing force from the forward biasing member, the forward locking mechanism easily locks. Accordingly, the intake cam phase becomes a locked state at the intake intermediate phase, as with the normal start, and thus the startability by the intermediate phase locking can be secured.

Furthermore, in the first aspect, an engine start in a forward-and-backward failure state, in which both the locking at the forward-most advanced phase by the forward locking mechanism and the locking at the backward-most retarded phase by the backward locking mechanism are released, may be assumed. At the engine start in the forward-and-backward failure state, when the backward phase is reached to the backward-most retarded phase by the cam torque biased in a retard direction on average, the backward locking mechanism easily locks according to the same principle as is in the case of the backward failure state. Further, at the engine start in the forward-and-backward failure state, the forward phase is reaches to the forward-most advanced phase by the biasing force from the forward biasing member, and thus the forward locking member easily locks according to the same principle as is in the case of the forward failure state. Accordingly, as with the normal start, the intake cam phase is in a locked state at the intake intermediate phase, and thus the startability by the intermediate phase locking can be secured.

It should be noted that, in the first aspect, at least one of the backward failure state, the forward failure state and the forward-and-backward failure state may be assumed in the valve control apparatus.

In a second aspect of the present disclosure, a valve control apparatus adjusts valve timing of an internal combustion engine. The engine has an intake valve that is opened and closed by a rotation of an intake cam shaft, and an exhaust valve that is opened and closed by a rotation of an exhaust cam shaft that receives a crank torque from a crank shaft. The valve control apparatus includes a forward phase adjustment unit that has a forward intermediate rotor rotatable relative to the exhaust cam shaft. The forward phase adjustment unit adjusts a forward phase that is a rotational phase of the forward intermediate rotor relative to the exhaust cam shaft. A backward phase adjustment unit has a backward intermediate rotor rotatable relative to the intake cam shaft and rotates in association with the forward intermediate rotor. The backward phase adjustment unit adjusts a backward phase that is a rotational phase of the intake cam shaft relative to the backward intermediate rotor. The forward phase adjustment unit includes a forward stopper mechanism that prevents further retard of the forward phase by engaging the forward intermediate rotor at a forward-most retarded phase, which is a furthest-most retarded phase of the forward phase. A forward locking mechanism locks the forward phase when reaching the forward-most retarded phase at a start time of the engine. The backward phase adjustment unit receives a cam torque from the intake cam shaft that is biased on average in a retard direction. A backward stopper mechanism prevents further advance of the backward phase by engaging the intake cam shaft at a backward-most advanced phase, which is a furthest-most advanced phase of the backward phase. A backward locking mechanism locks the backward phase when reaching the backward-most advanced phase at the start time of the engine. A backward biasing member biases the intake cam shaft in an advance direction and the backward intermediate rotor in the retard direction.

According to the second aspect, at a normal start, the forward phase that is a rotational phase of the forward intermediate rotor rotatable relative to the exhaust cam shaft, which is rotated by receiving the crank torque from the crank shaft, is locked at the forward-most retarded phase by the forward locking mechanism. Along with this, at the normal start, the backward phase that is a rotational phase of the intake cam shaft rotatable relative to the backward intermediate rotor, which is rotated in association with the forward intermediate rotor, is locked at the backward-most advanced phase by the backward locking mechanism. Thus, according to each function of the forward locking mechanism and the backward locking mechanism, the intake cam phase that is a rotational phase of the intake cam shaft relative to the crank shaft is locked at the intake intermediate phase, which is a combined phase of the forward-most retarded phase and the backward-most advanced phase. As a result, startability of the engine by intermediate phase locking can be secured.

In the second aspect, an engine start in a backward failure state, in which the locking at the backward-most advanced phase by the backward locking mechanism is released while the locking at the forward-most retarded phase is maintained by the forward locking mechanism, can be assumed. At the start in the backward failure state, the cam torque that is biased in the retard direction on average acts on the intake cam shaft. However, the backward biasing member biases the intake cam shaft in the advance direction against the averaged cam torque. As a result, when the backward phase is reached to the backward-most advanced phase by the biasing force from the backward biasing member, the backward stopper mechanism engages the intake cam shaft and further advance of the backward phase is prevented. Therefore, the backward locking mechanism easily locks, and thus the intake cam phase becomes a locked state at the intake intermediate phase, as with the normal start, and thus the startability by the intermediate phase locking can be secured.

Further, in the second aspect, an engine start in a forward failure state, in which the locking at the forward-most retarded phase by the forward locking mechanism is released while the locking at the backward-most advanced phase by the backward locking mechanism is maintained, can be assumed. At the start in the backward failure state, the cam torque that is biased in the retard direction on average acts on the intake cam shaft and the backward intermediate rotor. In this case, the cam torque biased in the retard direction on average is transmitted to the forward intermediate rotor that is rotated in association with the backward intermediate rotor. As a result, when the forward phase is reached to the forward-most retarded phase by the cam torque to the forward intermediate rotor, the forward stopper mechanism engages the forward intermediate rotor and further retard of the forward phase is prevented. Therefore, the forward locking mechanism easily locks. Therefore, the intake cam phase becomes a locked state at the intake intermediate phase, as with the normal start, and thus the startability by the intermediate phase locking can be secured.

Furthermore, in the second aspect, an engine start in a forward-and-backward failure state, in which both the locking at the forward-most retarded phase by the forward locking mechanism and the locking at the backward-most advanced phase by the backward locking mechanism are released, may be assumed. At the engine start in the forward-and-backward failure state, when the backward phase is reached to the backward-most advanced phase by the biasing force from the backward biasing member, the backward locking mechanism easily locks according to the same principle as is the case with the backward failure state. Further, the backward biasing member biases the backward intermediate rotor in the retard direction at the engine start in the forward-and-backward failure state. In this case, the biasing force from the backward biasing member is also transmitted to the forward intermediate rotor, which is rotated in association with the backward intermediate rotor. As a result, when the forward phase reaches the forward-most retarded phase by the biasing force biasing the forward intermediate rotor, the locking by the forward locking mechanism easily locks according to the same principle as is the case with the forward failure state. Accordingly, as with the normal start, the intake cam phase is in a locked state at the intake intermediate phase, and thus the startability by the intermediate phase locking can be secured.

It should be noted that, in the second aspect, at least one of the backward failure state, the forward failure state and the forward-and-backward failure state may be assumed in the valve control apparatus.

BRIEF DESCRIPTION OF THE DRAWINGS

The disclosure, together with additional objectives, features and advantages thereof, will be best understood from the following description, the appended claims and the accompanying drawings, in which:

Hereinafter, a plurality of embodiments of the present disclosure will be described with reference to the accompanying drawings. In each embodiment, the same reference signs are assigned to corresponding configuration elements, and there is a case where duplicated descriptions are omitted. In each embodiment, when only a part of a configuration of an embodiment is described, a corresponding configuration of another embodiment, which is previously described, is applicable to the other part of the configuration of the embodiment. Insofar as there are no problems with a combination of the configurations, not only can the configurations be combined together as stated in each embodiment, but also the configurations of the plurality of embodiments can be partially combined together even though the partial combinations of the configurations are not stated.

(First Embodiment)

Figure 1:
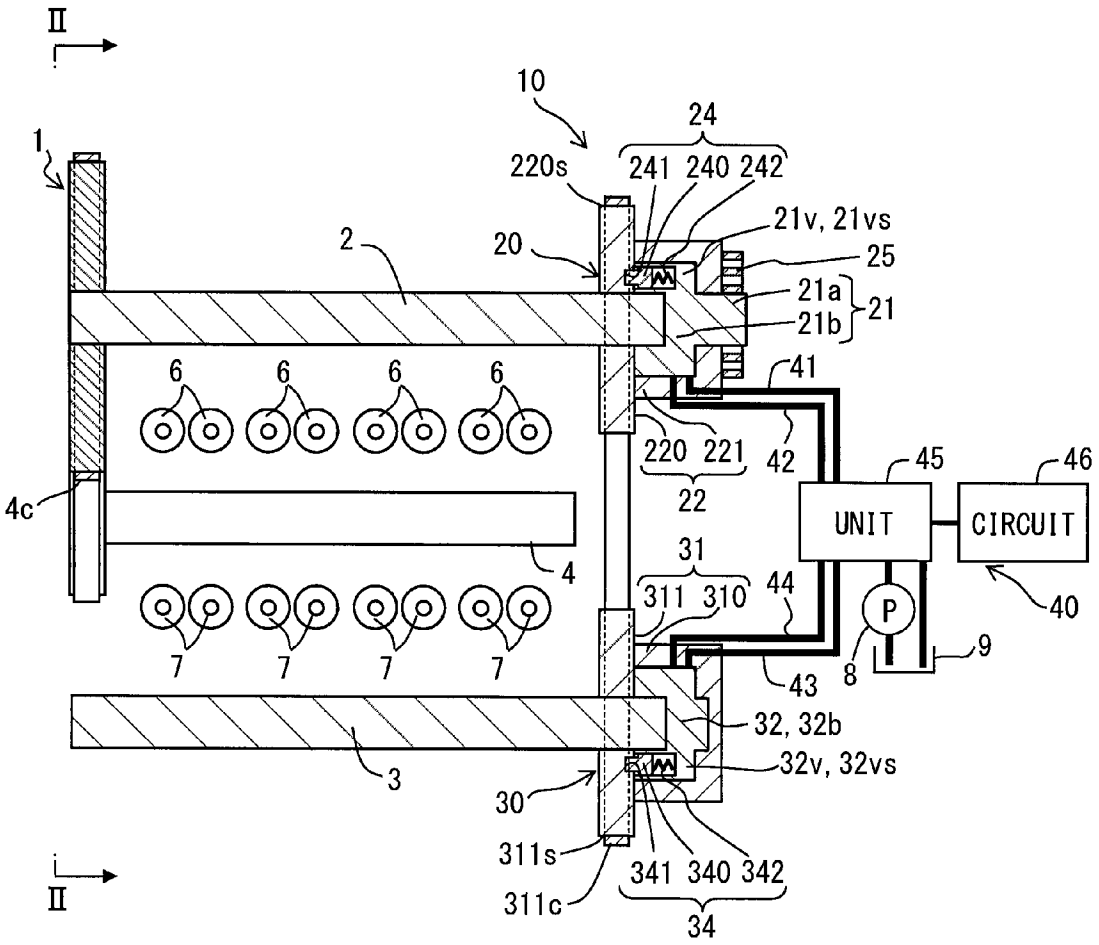
FIG. 1 is a configuration diagram taken along line I-I in FIGS. 2, 4 and 5 schematically illustrating a valve control apparatus that is mounted in an internal combustion engine according to a first embodiment.
Figure 2:
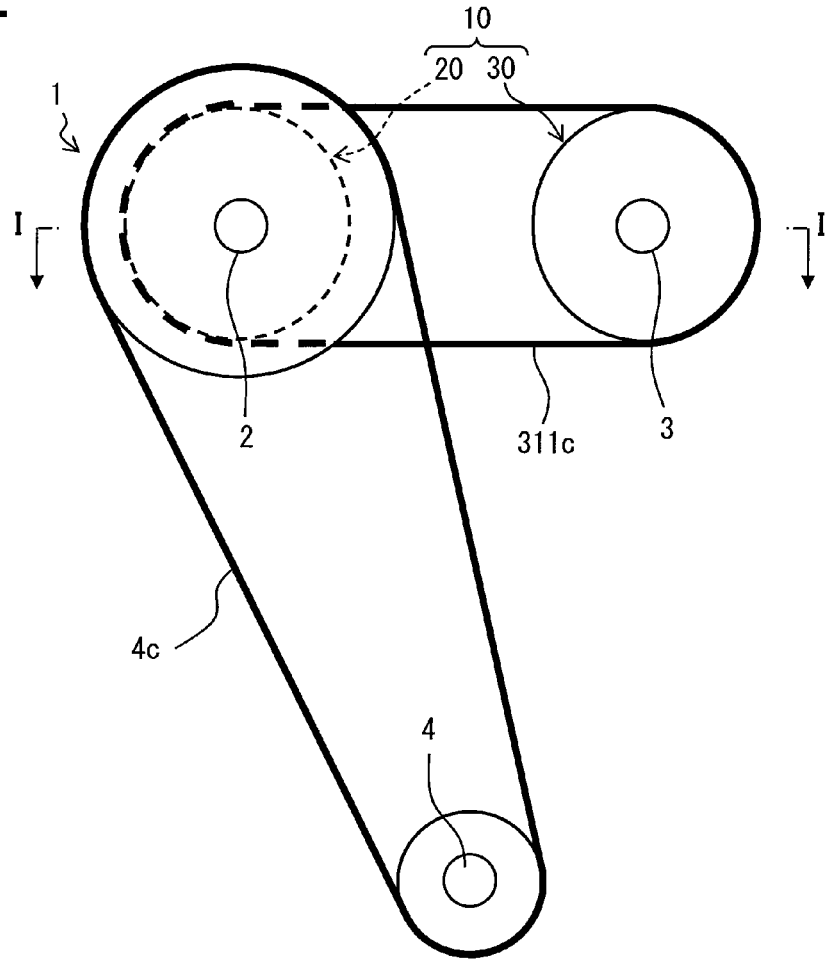
FIG. 2 is a diagram viewing from an arrow line II-II in FIG. 1.

As illustrated in FIGS. 1 and 2, a valve control apparatus 10 is installed in an internal combustion engine 1 (hereinafter "engine") for a vehicle.

(Engine)

The engine 1 is a so-called DOHC-type multi-cylinder reciprocating engine having a single exhaust cam shaft 2 and a single intake cam shaft 3 in a cylinder head. The exhaust cam shaft 2 in the engine 1 receives crank torque through a timing chain 4*c* that is wound between a crank shaft 4 and the exhaust cam shaft 2. When the cam shaft 2 is rotated by the crank torque, an exhaust valve 6 of each cylinder is opened and closed by an exhaust cam (not shown) that rotates integrally with the exhaust cam shaft 2. The intake cam shaft 3 in the engine 1 receives a crank torque from the crank shaft 4 through the timing chain 4*c* and the valve control apparatus 10. When the cam shaft 3 is rotated by the crank torque, an intake valve 7 of each cylinder is opened and closed by an intake cam (not shown) that rotates integrally with the intake cam shaft 3.

Figure 3:
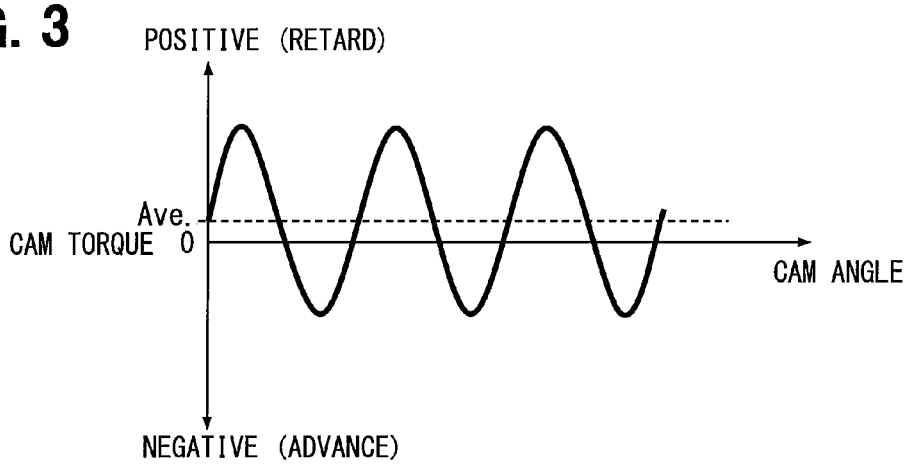
FIG. 3 is a characteristic graph of cam torque.

As shown in FIG. 3, a cam torque is generated by, for example, a spring repulsion force by the valves 6 and 7 that are objects to be driven for opening and closing. The cam torque acts alternately on the respective cam shafts 2 and 3 according to a cam angle (i.e., rotational angles of the cam shafts 2 and 3). The cam torque alternately changes between a negative torque that acts on the respective cam shaft 2 and 3 in an advance direction and a positive torque that acts on the respective cam shafts 2 and 3 in a retard direction. In the present embodiment, the peak of the positive torque is greater than the peak of the negative torque due to friction between the respective cam shafts 2 and 3 and bearings (not shown), and thus an averaged cam torque that is an average value of the positive torque and the negative torque is biased toward a positive torque side. In other words, the cam torque acting the respective cam shafts 2 and 3 is biased in the retard direction on average.

In the engine 1, a combustion state of fuel is optimized according to, for example, valve timing that is timing for opening and closing the respective valves 6 and 7. In the present embodiment, the engine 1, to which the valve control apparatus 10 is applied, is a gasoline engine where gasoline fuel is combusted inside each cylinder. However, a diesel engine where diesel fuel is combusted inside each cylinder may be used.

(Valve Control Apparatus)

The valve control apparatus 10 as shown in FIGS. 1 and 2 controls valve timing of the intake valve 7 by changing an intake cam phase that is a rotational phase of the intake cam shaft 3 relative to the crank shaft 4 while locking an exhaust cam phase that is a rotational phase of the exhaust cam shaft 2 relative to the crank shaft 4. Herein, the valve control apparatus 10 receives hydraulic oil as "hydraulic fluid" that is supplied from a drain pan 9 through a pump 8 as "supply source". That is, the valve control apparatus 10 is a hydraulic apparatus that controls the valve timing of the intake valve 7 using a pressure of the hydraulic oil supplied. Although the pump 8 of the present embodiment is a mechanical pump that starts supplying the hydraulic oil accompanying the start time of the engine 1, an electric pump that is capable of starting supplying the hydraulic oil in spite of the start of the engine 1 may be used.

Specifically, the valve control apparatus 10 includes a forward phase adjustment unit 20, a backward phase adjustment unit 30 and a control system 40 as shown in FIGS. 1, 2, 4 and 5.

Figure 4:
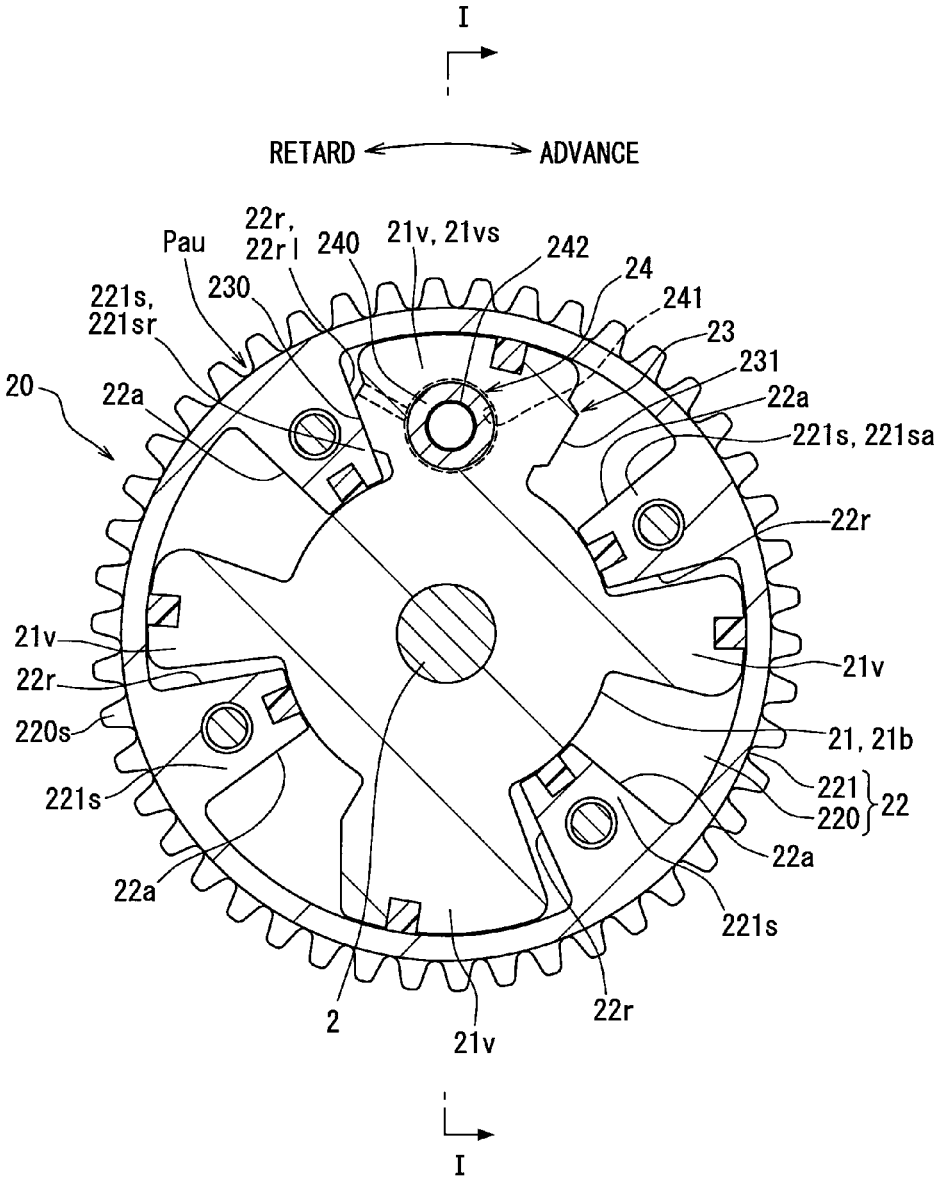
FIG. 4 is a cross-sectional view illustrating a forward phase adjustment unit of FIG. 1.

As shown in FIGS. 1 and 4, the forward phase adjustment unit 20 includes a forward link rotor 21, a forward intermediate rotor 22, a forward stopper mechanism 23, a forward locking mechanism 24 and a forward biasing member 25.

The forward link rotor 21 is a so-called vane rotor and is coaxially disposed with the exhaust cam shaft 2. In a forward body 21*b* of the forward link rotor 21, a plurality of vanes 21*v* are arranged at given intervals in a circumferential direction and each vane 21*v* protrudes outwardly in a radial direction. The forward body 21*b* is connected to one end of the exhaust cam shaft 2 opposite to the other end of the cam shaft 2 in an axial direction, around which the timing chain 4*c* is wound. The forward link rotor 21 is rotated together with the exhaust cam shaft 2, which is integrally formed with the link rotor 21, in association with the crank shaft 4 by receiving the crank torque from the cam shaft 2. The rotational direction of the forward link rotor 21 and the exhaust cam shaft 2 becomes a specified circumferential direction (e.g., a clockwise direction in FIG. 4).

The forward intermediate rotor 22 is coaxially disposed with the exhaust cam shaft 2. The forward intermediate rotor 22 is formed into a hollow shape by coaxially fastening a forward cover member 220 having an annular-plate-like shape to a forward housing member 221 having a bottomed cylindrical shape. The forward body 21*b* is housed inside a hollow space of the forward intermediate rotor 22.

The exhaust cam shaft 2 is inserted into the forward cover member 220 and is rotatable relative to the forward cover member 220. A forward sprocket 220*s*, which is formed into a spur gear shape, is provided entirely on an outer periphery of the forward cover member 220. A forward shaft portion 21*a* is inserted into a bottom of the forward housing member 221 and is rotatable relative to the forward housing member 221. The forward shaft portion 21*a* rotates integrally with the forward body 21*b* of the forward link rotor 21. As shown in FIG. 4, in the forward housing member 221, a plurality of shoes 221*s* are arranged at given intervals in the circumferential direction and each shoe 221*s* protrudes inwardly in the radial direction. The shoes 221*s* and the vanes 21*v* are positioned alternately in the circumferential direction. A forward advance chamber 22*a* is defined between each shoe 221*s* and each vane 21*v* that is adjacent to the shoe 221*s* in the retard direction of the circumferential direction. Further, a forward retard chamber 22*r* is defined between each shoe 221*s* and each vane 21*v* that is adjacent to the shoe 221*s* in the advance direction of the circumferential direction.

In this configuration, the hydraulic oil supplied from the pump 8 is introduced into and discharged from each chamber 22*a*, 22*r*. The forward intermediate rotor 22 receives the crank torque directly from the vanes 21*v* of the forward link rotor 21 or through the hydraulic oil introduced into each chamber 22*a*, 22*r*. By receiving the crank torque, the forward intermediate rotor 22 is rotated in the specified circumferential direction (e.g., the clockwise direction in FIG. 4) and is coaxially rotated relative to the forward link rotor 21 and the exhaust cam shaft 2.

The relative rotation of the forward intermediate rotor 22 relative to the forward link rotor 21 generates in the advance direction by introduction of the hydraulic oil into each forward advance chamber 22*a* and discharge of the hydraulic oil from each forward retard chamber 22*r*. In this case, a forward phase that is a rotational phase of the forward intermediate rotor 22 relative to the crank shaft 4 is adjusted in the advance direction according to the relative rotation of the forward intermediate rotor 22. Whereas, the relative rotation of the forward intermediate rotor 22 relative to the forward link rotor 21 generates in the retard direction by discharge of the hydraulic oil from each forward advance chamber 22*a* and introduction of the hydraulic oil into each forward retard chamber 22*r*. In this case, the forward phase is adjusted in the retard direction according to the relative rotation of the forward intermediate rotor 22. Further, the relative rotation of the forward intermediate rotor 22 relative to the forward link rotor 21 is prevented by confining the hydraulic oil inside each chamber 22*a*, 22*r*. In this case, the forward phase is held substantially constant according to the prevention at the relative rotation position.

Figure 6:
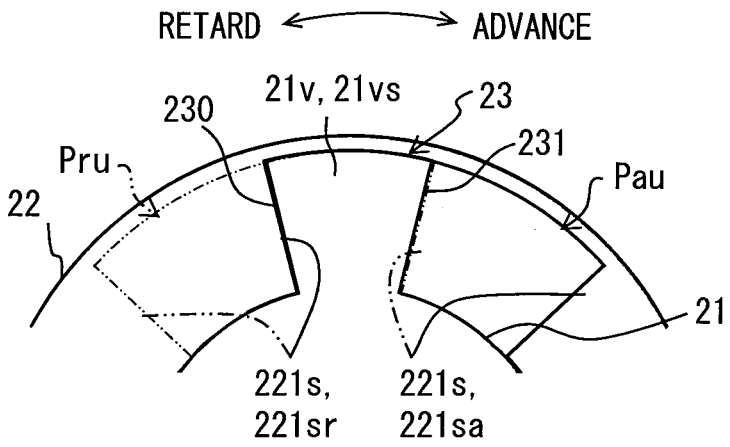
FIG. 6 is a diagram illustrating an operation of the forward phase adjustment unit of FIG. 4.

As shown in FIGS. 4 and 6, the forward stopper mechanism 23 is constituted by combining a forward advance stopper 230 and a forward retard stopper 231. The forward advance stopper 230 is defined by a specific vane 21*vs* that is one of the vanes 21*v*, more specifically, by a side of the specific vane 21*vs* that faces in the retard direction. The forward advance stopper 230 contacts against the shoe 221*sr* adjacent to the specific vane 21*vs* in the retard direction to engage the forward intermediate rotor 22 at a forward-most advanced phase Pau (refer to a solid line in FIGS. 4 and 6) that is the furthest-most advanced forward phase. By the engagement, the relative rotation of the forward intermediate rotor 22 relative to the forward link rotor 21 in the advance direction is prevented, so that further advance of the forward phase is prevented. The forward retard stopper 231 is defined by a side of the specific vane 21*vs* that faces in the advance direction. The forward retard stopper 231 contacts against the shoe 221*sa* adjacent to the specific vane 21*vs* in the advance direction to engage the forward intermediate rotor 22 at a forward-most retarded phase Pru (refer to a two-dot dashed line in FIG. 6) that is the furthest-most retarded forward phase. By the engagement, the relative rotation of the forward intermediate rotor 22 relative to the forward link rotor 21 in the retard direction is prevented, so that further retard of the forward phase is prevented.

As shown in FIGS. 1 and 4, the forward locking mechanism 24 is constituted by combining a forward locking member 240, a forward locking hole 241 and a forward elastic member 242. The forward locking member 240 having a bottomed cylindrical shape is supported by the specific vane 21*vs* and is capable of reciprocating along an axial direction of the forward link rotor 21. The forward locking member 240 is driven toward the bottom of the forward housing member 221 by receiving a pressure of the hydraulic oil from the forward retard chamber 22*rl* (refer to FIG. 4) between the specific vane 21*vs* and the shoe 221*sr*.

The forward locking hole 241 having a cylindrical hole shape is formed on an inside surface of the forward cover member 220. The forward elastic member 242 that is constituted by a coil spring is supported by the specific vane 21*vs*. The forward elastic member 242 biases the forward locking member 240 toward the forward cover member 220 by a restoring force of the forward elastic member 242. Therefore, when the forward phase reaches the forward-most advanced phase Pau (refer to FIG. 4) in a state where the pressure by the hydraulic oil from the forward retard chamber 22*rl* is reduced or eliminated, the forward locking member 240 is fitted into the forward locking hole 241 by the biasing force by the forward elastic member 242, as shown in FIG. 1. Thus, the forward phase is locked at the forward-most advanced phase Pau. When the hydraulic pressure from the forward retard chamber 22*rl* increases, the forward locking member 240 separates from the forward locking hole 241 against the biasing force by the forward elastic member 242. Thus, the locking of the forward phase at the forward-most advanced phase Pau is released.

As shown in FIG. 1, the forward biasing member 25 that is constituted by a helical spring is arranged outside the forward intermediate rotor 22 between the forward housing member 221 and the forward shaft portion 21*a*. The forward biasing member 25 biases the forward intermediate rotor 22 in the advance direction relative to the forward link rotor 21. In the present embodiment, a biasing torque generated to bias the forward intermediate rotor 22 is greater than the averaged cam torque which is transmitted from the intake cam shaft 3 to the forward intermediate rotor 22, as described below.

Figure 5:
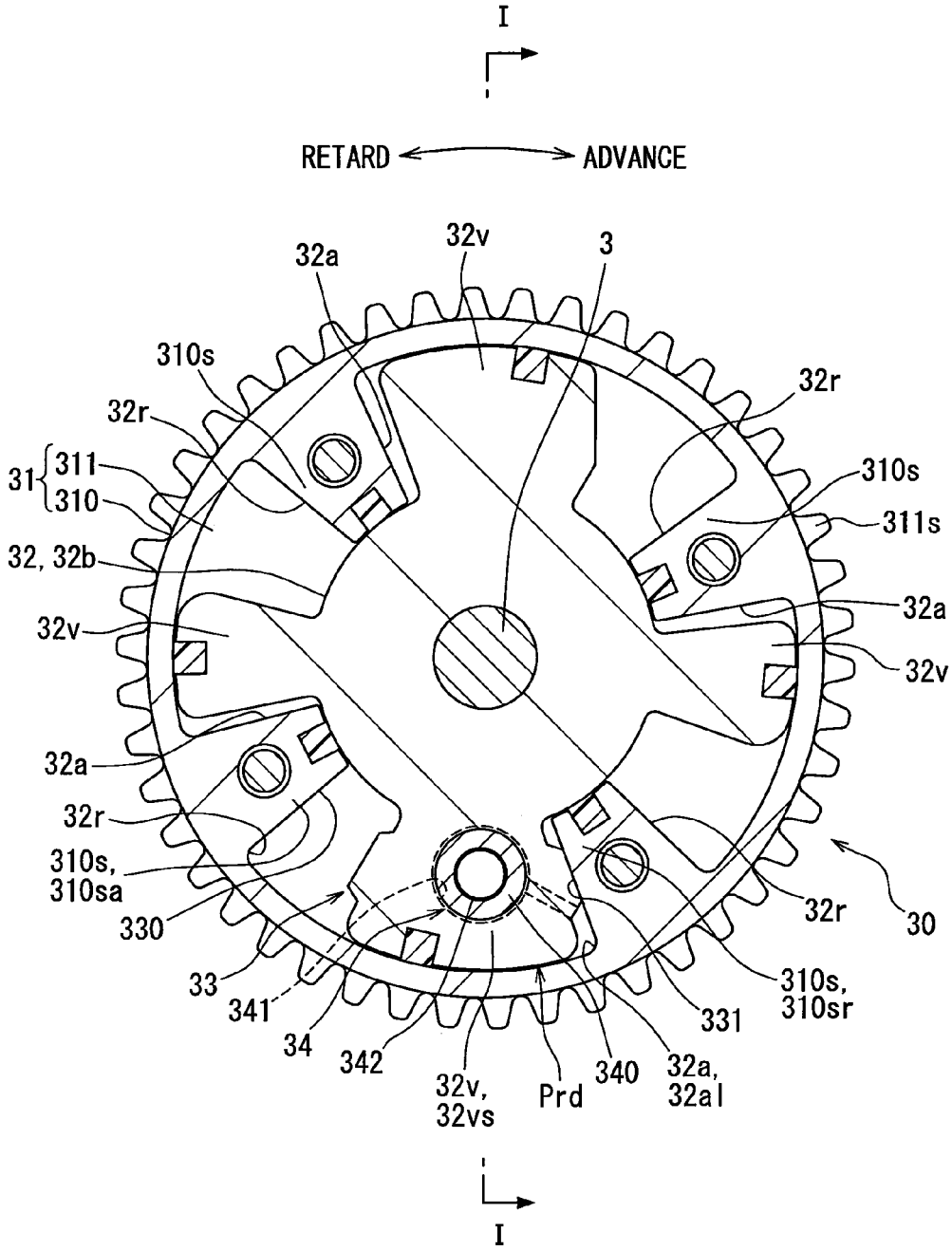
FIG. 5 is a cross-sectional view illustrating a backward phase adjustment unit of FIG. 1.

As shown in FIGS. 1 and 5, the backward phase adjustment unit 30 includes a backward intermediate rotor 31, a backward link rotor 32, a backward stopper mechanism 33 and a backward locking mechanism 34.

The backward intermediate rotor 31 is coaxially arranged with the intake cam shaft 3. The backward intermediate rotor 31 is formed into a hollow shape by coaxially fastening a backward housing member 310 having a bottomed cylindrical shape to a backward cover member 311 having an annular-plate-like shape. As shown in FIG. 5, the backward housing member 310 is provided with a plurality of shoes 310*s* at given intervals in a circumferential direction. Each shoe 310*s* protrudes from the backward housing member 310 inwardly in a radial direction.

As shown in FIGS. 1 and 5, the intake cam shaft 3 is inserted into the backward cover member 311 and is rotatable relative to the backward cover member 311. A backward sprocket 311*s*, which is formed into a spur gear shape, is provided entirely on an outer periphery of the backward cover member 311. The backward sprocket 311*s* is eccentric with respect to the forward sprocket 220*s* and a timing chain 311*c* (refer to FIG. 2) is wound between the backward sprocket 311*s* and the forward sprocket 220*s*. The backward intermediate rotor 31 is rotated in association with the forward intermediate rotor 22 by receiving the crank torque from the forward intermediate rotor 22 through the timing chain 311*c*. In this case, the rotational direction of the backward intermediate rotor 31 becomes a specified circumferential direction (e.g., a clockwise direction in FIG. 5).

The backward link rotor 32 is a so-called vane rotor and is coaxially arranged with the intake cam shaft 3. A backward body 32*b* of the backward link rotor 32 is housed inside a hollow space of the backward intermediate rotor 31. The backward body 32*b* is connected to one end of the intake cam shaft 3 which corresponds to the exhaust cam shaft 2 to which the forward link rotor 21 is connected. The backward link rotor 32 is rotated in association with the intake cam shaft 3, which is integrally formed with the backward link motor 32, by receiving the crank torque, as described below. In this case, the rotational directions of the backward link rotor 32 and the intake cam shaft 3 become the specified circumferential direction (e.g., the clockwise direction in FIG. 5).

As shown in FIG. 5, the backward body 32*b* is provided with a plurality of vanes 32*v* at given intervals in a circumferential direction. Each vane 32*v* outwardly protrudes in a radial direction. The vanes 32*v* and the shoes 310*s* are positioned alternately in the circumferential direction. A backward advance chamber 32*a* is defined between each vane 32*v* and the shoe 310*s* adjacent to the vane 32*v* in the retard direction of the circumferential direction. Further, a backward retard chamber 32*r* is defined between each vane 32*v* and the shoe 310*s* adjacent to the vane 32*v* in the advance direction of the circumferential direction.

The hydraulic oil supplied from the pump 8 is introduced into and discharged from each chamber 32*a*, 32*r*. The backward link rotor 32 receives the crank torque directly from each shoe 310*s* of the backward intermediate rotor 31 or through the hydraulic oil introduced into each chamber 32*a*, 32*r*. By the crank torque, the backward link rotor 32 is rotated in association with the intake cam shaft 3 and is relatively and coaxially rotated with respect to the backward intermediate rotor 31.

The relative rotation of the backward link rotor 32 relative to the backward intermediate rotor 31 generates in the advance direction by introduction of the hydraulic oil into each backward advance chamber 32*a* and discharge of the hydraulic oil from each backward retard chamber 32*r*. In this case, a backward phase that is a rotational phase of the intake cam shaft 3 relative to the backward intermediate rotor 31 is adjusted in the advance direction according to the relative rotation of the backward link rotor 32. Whereas, the relative rotation of the backward link rotor 32 relative to the backward intermediate rotor 31 generates in the retard direction by discharge of the hydraulic oil from each backward advance chamber 32*a* and introduction of the hydraulic oil into each backward retard chamber 32*r*. In this case, the forward phase is adjusted in the retard direction according to the relative rotation of the backward link rotor 32. Further, the relative rotation of the backward link rotor 32 relative to the backward intermediate rotor 31 is prevented by confining the hydraulic oil inside each chamber 32*a*, 32*r*. In this case, the backward phase is held substantially constant according to the regulation at the relative rotation position.

Figure 7:
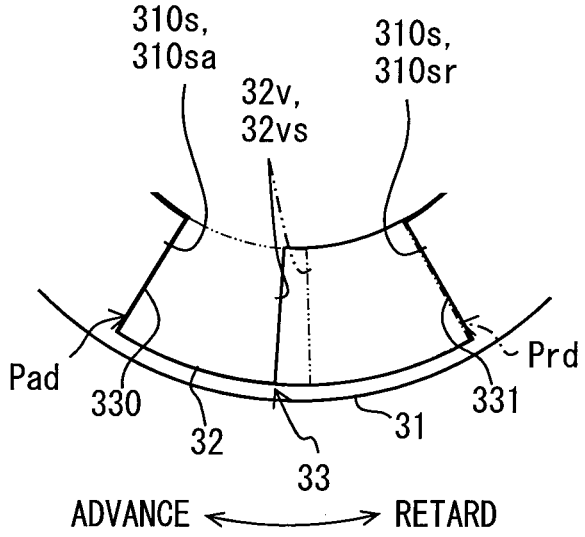
FIG. 7 is a diagram illustrating an operation of the backward phase adjustment unit of FIG. 5.

As shown in FIGS. 5 and 7, the backward stopper mechanism 33 is constituted by combining a backward advance stopper 330 and a backward retard stopper 331. The backward advance stopper 330 is defined by the shoe 310*sa* adjacent to a specific vane 32*vs* in the advance direction, which is one of the vanes 32*v*, more specifically, by a side of the shoe 310*sa* that faces in the retard direction. The backward advance stopper 330 contacts against the specific vane 32*vs* to engage the intake cam shaft 3 through the backward link rotor 32 at a backward-most advanced phase Pad (refer to a solid line in FIGS. 5 and 7) that is the furthest-most advanced backward phase. By the engagement, the relative rotation of the backward link rotor 32 relative to the backward intermediate rotor 31 in the advance direction is prevented, so that further advance of the backward phase is prevented. The backward retard stopper 331 is defined by the shoe 310*sr* adjacent to the specific vane 32*vs* in the retard direction, more specifically, by a side of the shoe 310*sr* that faces in the advance direction. The backward retard stopper 331 contacts against the specific vane 32*vs* to engage the intake cam shaft 3 through the backward link rotor 32 at a backward-most retarded phase Prd (refer to a two-dot dashed line in FIG. 7) that is the furthest-most retarded backward phase. By the engagement, the relative rotation of the backward link rotor 32 relative to the backward intermediate rotor 31 in the retard direction is prevented, so that further retard of the backward phase is prevented.

In the present embodiment, an angular width of the backward phase between the backward-most advanced phase Pad and the backward-most retarded phase Prd is set to be substantially the same as that of the forward phase between the forward-most advanced phase Pau and the forward-most retarded phase Pru. Although the following will described based on the condition of the angular width of the backward phase and the forward phase, the angular width of the backward phase and the forward phase may be set to be deferent from each other.

As shown in FIGS. 1 and 5, the backward locking mechanism 34 is constituted by combining a backward locking member 340, a backward locking hole 341 and a backward elastic member 342. The backward locking member 340 having a bottomed cylindrical shape is supported by the specific vane 32*vs* and is capable of reciprocating along the axial direction of the backward link rotor 32. The backward locking member 340 is driven toward a bottom of the backward housing member 310 by receiving a pressure of the hydraulic oil from a backward advance chamber 32*al* (refer to FIG. 5) between the specific vane 32*vs* and the shoe 310*sr*.

The backward locking hole 341 having a cylindrical hole shape is formed on an inside surface of the backward cover member 311. The backward elastic member 342 that is constituted by a coil spring is supported by the specific vane 32*vs*. The backward elastic member 342 biases the backward locking member 340 toward the backward cover member 311 by a restoring force of the backward elastic member 342. Therefore, when the backward phase reaches the backward-most retarded phase Prd (refer to FIG. 5) in a state where the pressure of the hydraulic oil from the backward advance chamber 32*al* is reduced or eliminated, the backward locking member 340 is fitted into the backward locking hole 341 by the biasing force by the backward elastic member 342 as shown in FIG. 1. Thus, the backward phase is locked at the backward-most advanced phase Prd. When the hydraulic pressure from the backward advance chamber 32*al* increases, the backward locking member 340 separates from the backward locking hole 341 against the biasing force by the backward elastic member 342. Thus, the locking of the backward phase at the backward-most retarded phase Prd is released.

As shown in FIG. 1, the control system 40 includes a forward advance passage 41, a forward retard passage 42, a backward advance passage 43, a backward retard passage 44, a switching control unit 45 and an engine control circuit 46. The forward advance passage 41 is communicated to each forward advance chamber 22*a*. The forward retard passage 42 is communicated to each forward retard chamber 22*r*. The backward advance passage 43 is communicated to each backward advance chamber 32*a*. The backward retard passage 44 is communicated to each backward retard chamber 32*r*.

The switching control unit 45 is constituted with a single or a plurality of electromagnetic-type direction control valves and is attached to the engine 1. The switching control unit 45 is communicated to the passages 41, 42, 43 and 44, the pump 8 and the drain pan 9. The switching control unit 45 switches the communication of each passage 41, 42, 43 and 44 to the pump 8 and the drain pan 9.

More specifically, the switching control unit 45 executes a forward advance operation for the forward phase adjustment unit 20. In the operation, the switching control unit 45 controls the forward advance passage 41 to be communicated to the pump 8 and controls the forward retard passage 42 to be communicated to the drain pan 9. As the result of the forward advance operation, the hydraulic oil is introduced into each forward advance chamber 22*a* and is discharged from each forward retard chamber 22*r*, and thus the forward phase is advanced. Whereas, the switching control unit 45 executes a forward retard operation for the forward phase adjustment unit 20. In the operation, the switching control unit 45 controls the forward advance passage 41 to be communicated to the drain pan 9 and controls the forward retard passage 42 to be communicated to the pump 8. As the result of the forward retard operation, the hydraulic oil is discharged from each forward advance chamber 22*a* and is introduced into each forward retard chamber 22*r*, and thus, the forward phase is retarded. Further, the switching control unit 45 executes a forward maintaining operation for the forward phase adjustment unit 20. In the forward maintaining operation, the switching control unit 45 controls both the forward advance passage 41 and the forward retard passage 42 to shut off the communication of the passages 41 and 42 to both the pump 8 and the drain pan 9. As the result of the forward maintaining operation, the hydraulic oil is confined inside each chamber 22*a*, 22*r*, and thus the forward phase is maintained.

In addition to the above-described operations for the forward phase adjustment unit 20, the switching control unit 45 executes a backward advance operation for the backward phase adjustment unit 30. In the backward advance operation, the switching control unit 45 controls the backward advance passage 43 to be communicated to the pump 8 and controls the backward retard passage 44 to be communicated to the drain pan 9. As the result of the backward advance operation, the hydraulic oil is introduced into each backward advance chamber 32*a* and is discharged from each backward retard chamber 32*r*, and thus the backward phase is advanced. Whereas, the switching control unit 45 executes a backward retard operation for the backward phase adjustment unit 30. In the operation, the switching control unit 45 controls the backward advance passage 43 to be communicated to the drain pan 9 and controls the backward retard passage 44 to be communicated to the pump 8. As the result of the backward retard operation, the hydraulic oil is discharged from each backward advance chamber 32*a* and is introduced into each backward retard chamber 32*r*, and thus the backward phase is retarded. Further, the switching control unit 45 executes a backward maintaining operation for the backward phase adjustment unit 30. In the backward maintaining operation, the switching control unit 45 controls both the backward advance passage 43 and the backward retard passage 44 to shut off the communication of the passages 43 and 44 to both the pump 8 and the drain pan 9. As the result of the backward maintaining operation, the hydraulic oil is confined inside each chamber 32*a*, 32*r*, and thus the backward phase is maintained.

Figure 8A:
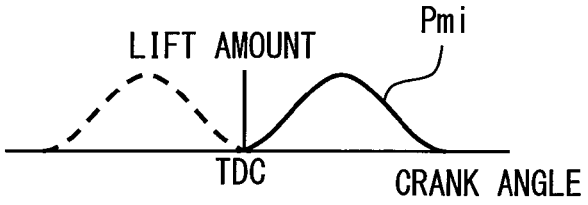
FIG. 8A is a characteristic graph of the valve control apparatus according to the first to third embodiments.
Figure 8B:
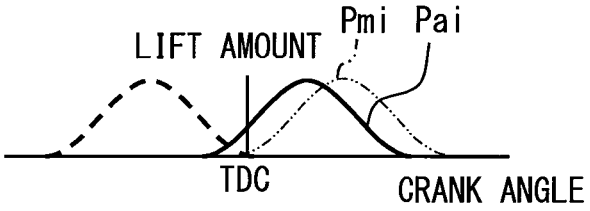
FIG. 8B is a characteristic graph of the valve control apparatus according to the first to third embodiments.
Figure 8C:
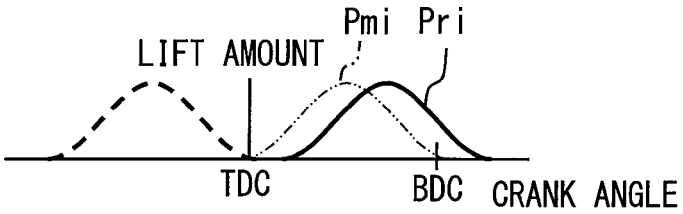
FIG. 8C is a characteristic graph of the valve control apparatus according to the first to third embodiment.

By adjusting the forward phase and the backward phase individually as described above, an intake cam phase (i.e., valve timing of the intake valve 7) that is a combined phase of the forward phase and the backward phase changes as shown in, for example, FIGS. 8A, 8B and 8C. In FIGS. 8A, 8B and 8C, a solid line represents a lift amount of the intake valve 7 according to a crank angle (i.e., a rotational angle of the crank shaft 4) and a broken line represents a lift amount of the exhaust valve 6 according to the crank angle.

More specifically, in FIG. 8A, the solid line shows the intake cam phase when the forward phase is adjusted to the forward-most advanced phase Pau and the backward phase is adjusted to the backward-most retarded phase Prd, or when the forward phase is adjusted to the forward-most retarded phase Pru and the backward phase is adjusted to the backward-most advanced phase Pad. In this case, the intake cam phase becomes a phase at which startability of the engine 1 can be improved even during a cold start under a low temperature environment. That is, the intake cam phase becomes a combined phase of the forward-most advanced phase Pau and the backward-most retarded phase Prd, or a combined phase of the forward-most retarded phase Pru and the backward-most advanced phase Pad. In other words, each combined phase becomes an intake intermediate phase Pmi that is between an intake most advanced phase Pai and an intake most retarded phase Pri. As shown in FIG. 8B, the intake most advanced phase Pai is determined by combining the forward-most advanced phase Pau and the backward-most advanced phase Pad, and, as shown in FIG. 8C, the intake most retarded phase Pri is made by combining the forward-most retarded phase Pru and the backward-most retarded phase Prd.

In FIG. 8B, the solid line shows the intake cam phase when the forward phase is adjusted to the forward-most advanced phase Pau and when the backward phase is adjusted to the backward-most advanced phase Pad. In this case, the intake cam phase becomes the combined phase of the forward-most advanced phase Pau and the backward-most advanced phase Pad, i.e., the intake most advanced phase Pai. In FIG. 8C, the solid line shows the intake cam phase when the forward phase is adjusted to the forward-most retarded phase Pru and when the backward phase is adjusted to the backward-most retarded phase Prd. In this case, the intake cam phase becomes the combined phase of the forward-most retarded phase Pru and the backward-most retarded phase Prd, i.e. the intake most retarded phase Pri. It should be noted that a two-dot line in FIGS. 8B and 8C shows the intake intermediate phase Pmi for comparison.

The engine control circuit 46 illustrated in FIG. 1 is mainly constituted by a microcomputer and is attached to the engine 1. The engine control circuit 46 is electrically connected to the switching control unit 45 and various electrical components for the engine 1. The engine control circuit 46 outputs commands according to computer programs to control the operation of the engine 1 including the operation of the switching control unit 45.

More specifically, the engine control circuit 46 outputs a command for either one of the forward advance operation, the forward retard operation or the forward maintaining operation for the forward phase adjustment unit 20 to the switching control unit 45 during a normal operation of the engine 1. Especially, when a command to keep the forward advance operation or a command for the forward maintaining operation is output after the forward phase is reached to the forward-most advanced phase Pau by the forward advance operation, locking at the phase Pau by the forward locking mechanism 24 is maintained. Further, the engine control circuit 46 outputs a command for either one of the backward advance operation, the backward retard operation or the backward maintaining operation for the backward phase adjustment unit 30 to the switching control unit 45 during a normal operation of the engine 1. In this case, especially, when a command to keep the backward retard operation or a command for the backward maintaining operation is output after the backward phase is reached to the backward-most retarded phase Prd by the backward retard operation, locking at the phase Prd by the backward locking mechanism 34 is maintained.

According to the above-described control, any of the following operation states (1A), (1B), (1C) or (1D) are produced during the normal operation.

(1A) An intake initial state in which both the locking at the forward-most advanced phase Pau by the forward locking mechanism 24 and the locking at the backward-most retarded phase Prd by the backward locking mechanism 34 are performed, one of the forward advance operation or the forward maintaining operation is executed, and one of the backward retard operation or the backward maintaining operation is executed.

(1B) A state in which the locking by the backward locking mechanism 34 is released while the locking by the forward locking mechanism 24 is maintained, and either one of the backward advance operation, the backward retard operation or the backward maintaining operation is executed.

(1C) A state in which the locking by the forward locking mechanism 24 is released while the locking by the backward locking mechanism 34 is maintained, and either one of the forward advance operation, the forward retard operation or the forward maintaining operation is executed.

(1D) A state in which both the locking by the forward locking mechanism 24 and the locking by the backward locking mechanism 34 are released, one of the forward advance operation, the forward retard operation or the forward maintaining operation is executed, and one of the backward advance operation, the backward retard operation or the backward maintaining operation is executed.

For example, when the backward phase reaches the backward-most advanced phase Pad by shifting a state from the intake initial state (1A) as shown in FIG. 8A to the state (1B) in which the backward advance operation is executed, the intake cam phase becomes the intake most advanced phase Pai as shown in FIG. 8B. In this case, the intake valve 7 is opened before timing when the piston within each cylinder reaches a top dead center TDC and the exhaust valve 6 is closed. As a result, when the engine 1 is in a middle load region, for example, exhaust gas is introduced into each cylinder through an exhaust port opened by the exhaust valve 6 according to a lift amount of the piston, which is moving up for the top dead center TDC. That is, by generating so-called internal EGR, pumping loss and nitrogen oxides (NOx) in the exhaust gas can be reduced, and thus fuel efficiency and environmental performance can be improved.

Further, when the forward phase reaches the backward-most retarded phase Pru by shifting a state from the intake initial state (1A) as shown in FIG. 8A to the state (1C) in which the forward retard operation is executed, the intake cam phase becomes the intake most retarded phase Pri as shown in FIG. 8C. In this case, the intake valve 7 is closed after timing when the piston within each cylinder reaches a bottom dead center BDC. As a result, when the engine 1 is in a low load and low speed region, for example, intake gas is flown back into an intake port opened by the intake valve 7 in the cylinder according to a lift amount of the piston, which is moving up from the bottom dead center BDC. That is, as a result of the blow-back, the pumping loss can be reduced, and thus fuel efficiency of the engine 1 can be improved.

At a normal stop in which the engine 1 is stopped according to a stop command during the normal operation, the engine control circuit 46 outputs the forward advance operation and the backward retard operation to the switching control unit 45. As the result of the command, the forward phase is reached to the forward-most advanced phase Pau and the forward stopper mechanism 23 engages the forward intermediate rotor 22. Accordingly, the forward phase is locked at the forward-most advanced phase Pau by the forward locking mechanism 24. Along with this, the backward phase is reached to the backward-most retarded phase Prd and the backward stopper mechanism 33 engages the intake cam shaft 3 through the backward link rotor 32. Thus, the backward phase is locked at the backward-most retarded phase Prd by the backward locking mechanism 34. It should be noted that the stop command includes an OFF command for an engine switch, an idle stop command for an idle stop system, or the like.

At a normal start in which the engine 1 is started according to a start command after the normal stop, the engine control circuit 46 outputs the forward advance operation and the backward retard operation to the switching control unit 45. As the result of the command, the hydraulic oil supplied from the pump 8 is neither introduced into the forward retard chamber 22*rl* nor the backward advance chamber 32*al* and the pressure of the hydraulic oil to act on the forward locking member 240 and the backward locking member 340 is left substantially extinguished. It should be noted that the start command includes an ON command for the engine switch, a restart command for the idle stop system, or the like.

At the above-described normal start, the forward phase that is the rotational phase of the forward intermediate rotor 22 rotatable relative to the exhaust cam shaft 2, which is rotated by receiving the crank torque from the crank shaft 4, is locked at the forward-most advanced phase Pau by the forward locking mechanism 24. Along with this, at the normal start (i.e., start time), the backward phase that is the rotational phase of the intake cam shaft 3 rotatable relative to the backward intermediate rotor 31, which is rotated in association with the forward intermediate rotor 22, is locked at the backward-most retarded phase Prd by the backward locking mechanism 34. Thus, according to each function of the forward locking mechanism 24 and the backward locking mechanism 34, the intake cam phase that is the rotational phase of the intake cam shaft 3 relative to the crank shaft 4 is locked at the intake intermediate phase Pmi, which is the combined phase of the forward-most advanced phase Pau and the backward-most retarded phase Prd. As a result, startability of the engine 1 by the intermediate phase locking can be improved.

In the first embodiment, under the locking at the forward-most advanced phase Pau by the forward locking mechanism 24, an engine start in a backward failure state in which the locking at the backward-most retarded phase Prd by the backward locking mechanism 34 is released can be assumed. For example, a case in which the engine 1 is started according to the start command after an engine stall (i.e., the engine 1 is stopped in a moment at a phase other than the intake intermediate phase Pmi) at the operation state (1B) during the normal operation can be assumed. The locking by the forward locking mechanism 24 is maintained since, at the engine start in the backward failure state, as with the normal start, the engine control circuit 46 outputs commands for the forward advance operation and the backward retard operation to the switching control unit 45.

At the above-described start in the backward failure state, the cam torque that is biased toward a retard direction on average acts on the intake cam shaft 3. As a result, when the backward phase is reached to the backward-most retarded phase Prd by the cam torque toward the intake cam shaft 3, the backward stopper mechanism 33 engages the intake cam shaft 3 and further retard of the backward phase is prevented. Therefore, the backward locking mechanism 34 may easily lock, and thus the intake cam phase becomes a locked state at the intake intermediate phase Pmi, as with the normal start, and the startability by the intermediate phase locking can be improved.

Further, in the first embodiment, an engine start in a forward failure state, in which the locking at the forward-most advanced phase Pau by the forward locking mechanism 24 is released while the locking at the backward-most retarded phase Prd by the backward locking mechanism 34 is maintained, can be assumed. For example, a case in which the engine 1 is started according to the start command after an engine stall (i.e., the engine 1 is stopped in a moment at a phase other than the intake intermediate phase Pmi) at the operation state (1C) during the normal operation can be assumed. The locking by the backward locking mechanism 34 is maintained since, at the engine start in the forward failure state, as with the normal start, the engine control circuit 46 outputs commands for the forward advance operation and the backward retard operation to the switching control unit 45.

At the above-described start in the forward failure state, the cam torque biased toward a retard direction on average acts on the intake cam shaft 3 and the backward intermediate rotor 31. At this time, the cam torque biased toward the retard direction on average is transmitted to the forward intermediated rotor 22, which rotates in association with the backward intermediate rotor 31. However, the forward biasing member 25 produces the biasing force to bias the forward intermediate rotor 22 in the advance direction against the averaged cam torque. As a result, when the forward phase is reached to the forward-most advanced phase Pau by the biasing force from the forward biasing member 25, the forward stopper mechanism 23 engages the forward intermediate rotor 22. Therefore, further advance of the forward phase is prevented, and thus the locking by the forward locking mechanism 24 becomes easy. Accordingly, the intake cam phase becomes a locked state at the intake intermediate phase Pmi, as with the normal start, and the startability by the intermediate phase locking can be secured.

Furthermore, in the first embodiment, an engine start in a forward-and-backward failure state, in which both the locking at the forward-most advanced phase Pau by the forward locking mechanism 24 and the locking at the backward-most retarded phase Prd by the backward locking mechanism 34 are released, can be assumed. For example, a case in which the engine 1 is started according to the start command after an engine stall (i.e., the engine 1 is stopped in a moment at a phase other than the intake intermediate phase Pmi) at the operation state (1D) during the normal operation can be assumed. The engine control circuit 46 outputs commands for the forward advance operation and the backward retard operation to the switching control unit 45 at the engine start in the forward-and-backward failure state.

At the above-described engine start in the forward-and-backward failure state, when the backward phase is reached to the backward-most retarded phase Prd by the cam torque biased toward the retard direction on average, the locking by the backward locking mechanism 34 becomes easy according to the same principle as is in the case of the backward failure state. Further, at the engine start in the forward-and-backward failure state, the forward phase is reaches to the forward-most advanced phase Pau by the biasing force from the forward biasing member 25, the locking by the forward locking mechanism 24 becomes easy according to the same principle as is in the case of the forward failure state. Accordingly, as with the normal start, the intake cam phase is in a locked state at the intake intermediate phase Pmi, and thus the startability by the intermediate phase locking can be secured.

In addition to the above, in the first embodiment, the forward intermediate rotor 22 is rotated relative to the forward link rotor 21, which rotates in association with the crank shaft 4 together with the exhaust cam shaft 2, by the pressure of the hydraulic oil from the pump 8. As a result, the forward phase is adjusted according to the relative rotation. Along with this, in the first embodiment, the backward link rotor 32 that rotates in association with the intake cam shaft 3 is rotated relative to the backward intermediate rotor 31 by pressure of the hydraulic oil from the pump 8. As a result, the backward phase is adjusted according to the relative rotation. As described above, by adjusting the forward phase and the backward phase using the pressure of the hydraulic oil, a variable responsiveness of the intake cam phase that is the combined phase of the forward phase and the backward phase can be secured and the startability by the intermediate phase locking can be also secured at the engine start.

Further, in the first embodiment, regarding the forward phase and the backward phase that are adjusted using the pressure of the hydraulic oil generated upon the supply start of the pump 8, since the pressure of the hydraulic oil becomes substantially zero or low during the engine start, it is difficult for both forward and backward phases to be changed by the pressure of the hydraulic oil. Thus, at the engine start of the respective forward-and-backward failure state, it is difficult by the pressure of the hydraulic oil to prevent at least one of the forward phase and the backward phase, at which the locking is released, from reaching to the rotational phase necessary for locking by the cam torque or biasing force. Therefore, the variable responsiveness of the intake cam phase can be secured at the normal operation while the startability by the intermediate phase locking can be surely secured.

(Second Embodiment)

Figure 9:
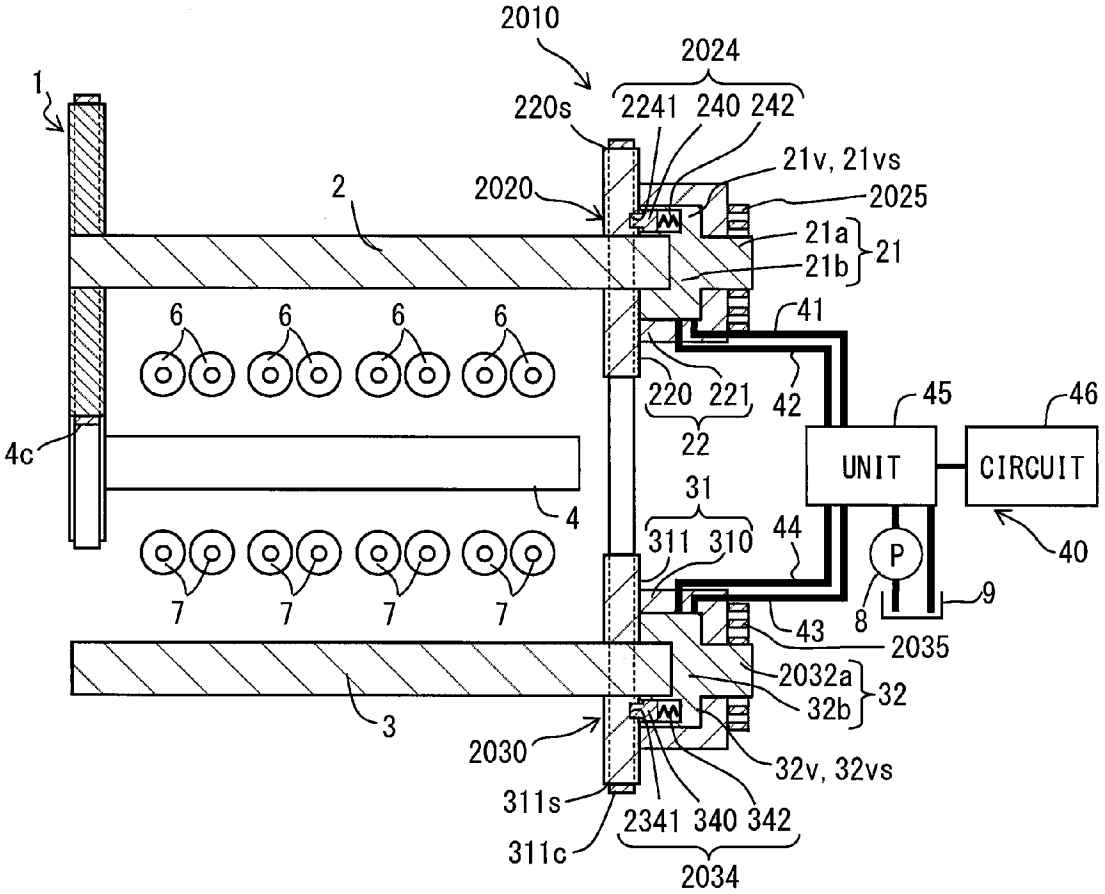
FIG. 9 is a configuration diagram taken along line IX-IX in FIGS. 10 and 11 illustrating a valve control apparatus that is mounted in an internal combustion engine according to the second embodiment.
Figure 10:
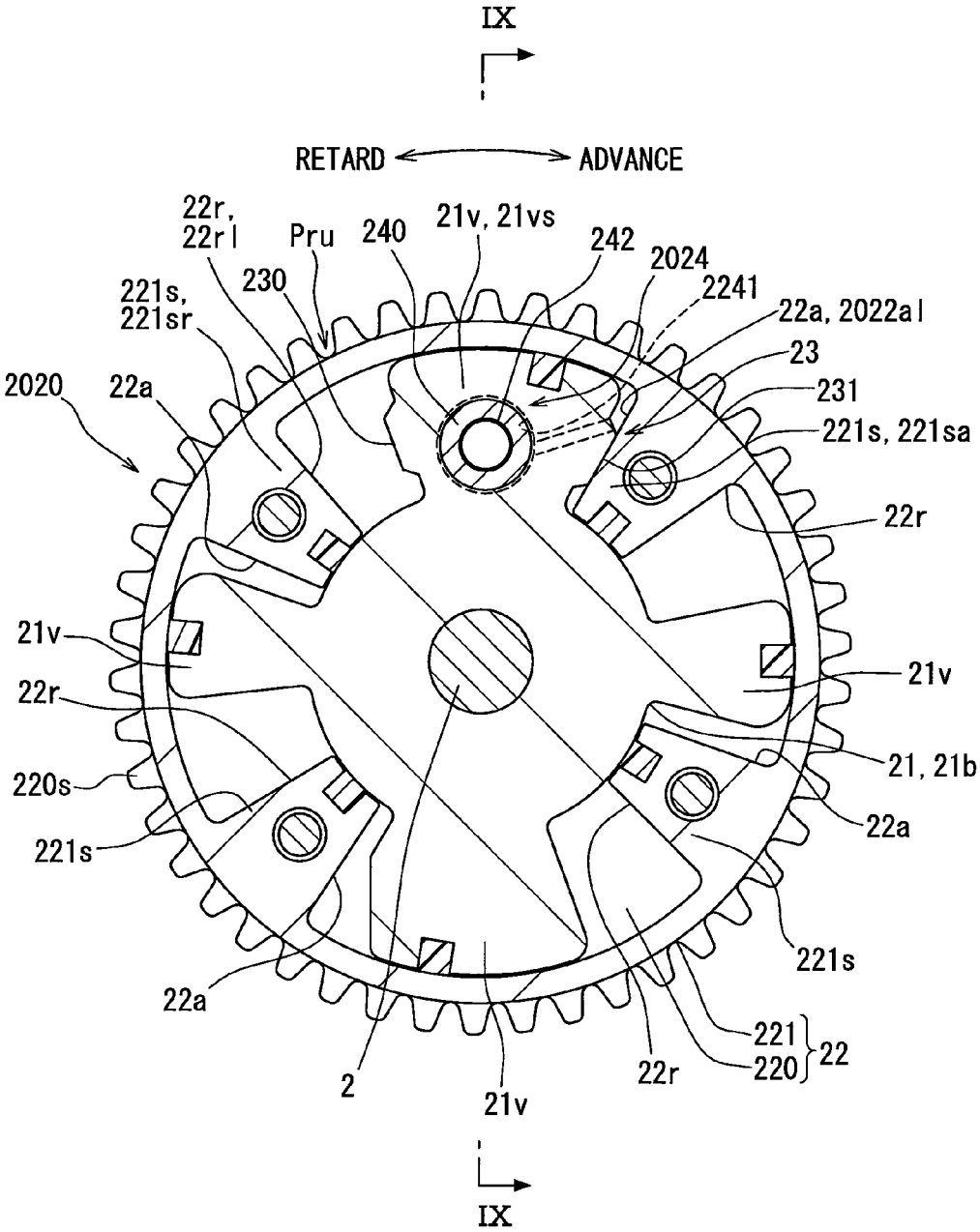
FIG. 10 is a cross-sectional view illustrating a forward phase adjustment unit in FIG. 9.
Figure 11:
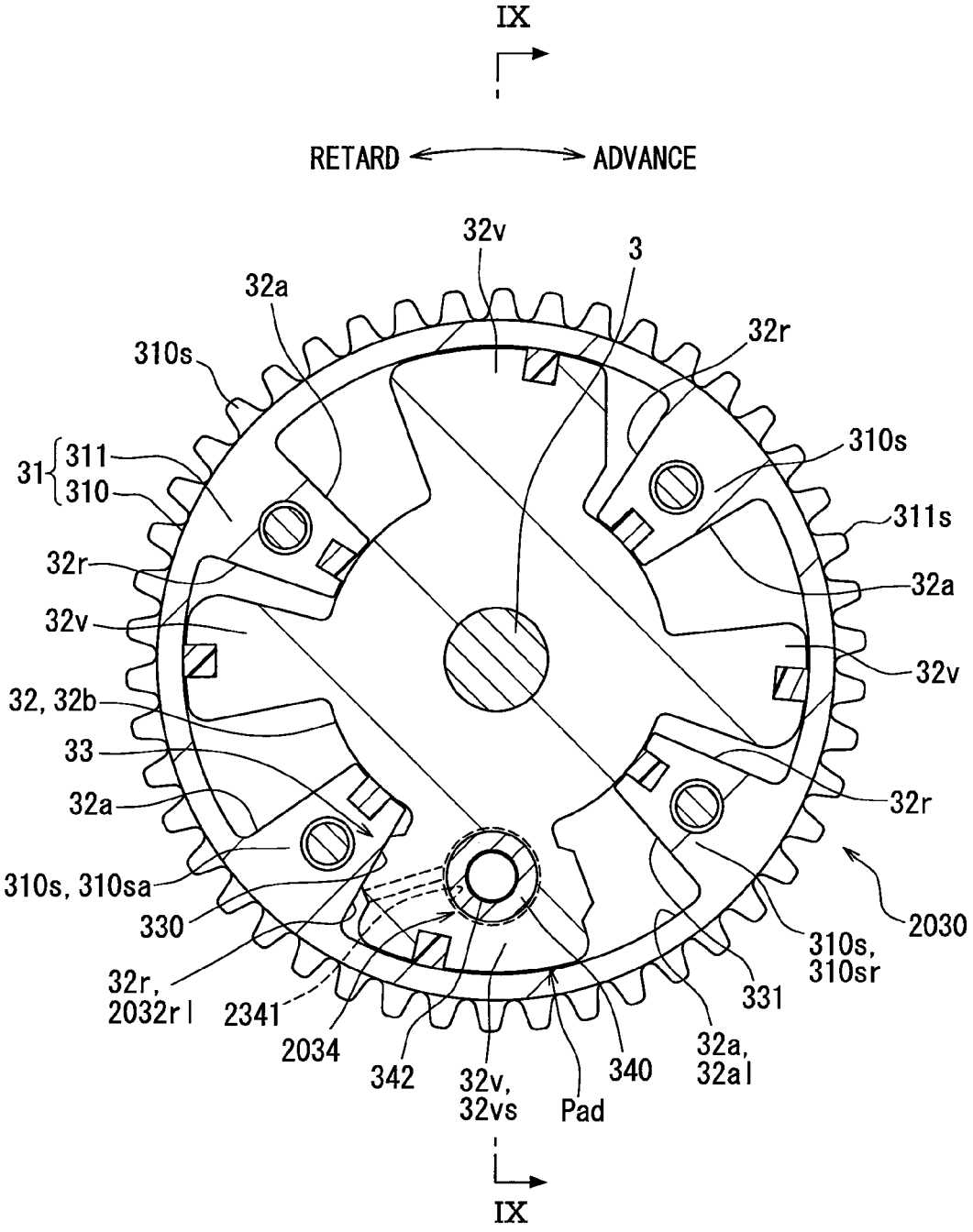
FIG. 11 is a cross-sectional view illustrating a backward phase adjustment unit in FIG. 9.

As shown in FIGS. 9 to 11, the second embodiment of the present disclosure is a modification to the first embodiment.

In a valve control apparatus 2010 of the second embodiment as shown in FIGS. 9 and 10, a forward phase adjustment unit 2020 includes a forward locking mechanism 2024 and a forward biasing member 2025, each of which has a different configuration from that of the first embodiment.

Specifically, a forward locking member 240 of the forward locking mechanism 2024 is driven toward a bottom of the forward housing member 221 by receiving a pressure of the hydraulic oil from a forward advance chamber 2022*al* between the specific vane 21*vs* among a plurality of the forward advance chamber 22*a* and a shoe 221*sa*. Further, in the forward locking mechanism 2024, a position where a forward locking hole 2241 in a forward cover member 220 is more shifted in an advance direction than that of the forward locking hole 241 of the first embodiment.

According to the configuration, when the forward phase is reached to the forward-most retarded phase Pru as shown in FIG. 10 in a state in which pressure of the hydraulic oil from the forward advance chamber 2022*al* decreases or extinguishes, the forward locking member 240 is fit into a forward locking hole 2241 as shown in FIG. 9 by a biasing force from a forward elastic member 242. By the fitting, the forward phase is locked at the forward-most retarded phase Pru. Whereas, when the pressure of the hydraulic oil from the forward advance chamber 2022*al*, the forward locking member 240 separates from the forward locking hole 2241 (not shown) against the biasing force from the forward elastic member 242. By the separation, the forward phase locking at the forward-most retarded phase Pru is released.

As shown in FIG. 9, a forward biasing member 2025 is constituted by a helical spring wound in a direction opposite to that of the forward biasing member 25 of the first embodiment. The forward biasing member 2025 is arranged outside the forward intermediate rotor 22 and is interposed between the forward housing member 221 and the forward shaft portion 21*a*. The forward biasing member 2025 biases the forward intermediate rotor 22 in the retard direction relative to the forward link rotor 21 by applying a restoring force to the forward housing member 221.

In addition to the above-mentioned forward phase adjustment unit 2020, a backward phase adjustment unit 2030 of the second embodiment as shown in FIGS. 9 and 11 includes a backward locking mechanism 2034 and a backward biasing member 2035. The backward locking mechanism 2034 has a different configuration from that of the backward locking mechanism 34 of the first embodiment.

Specifically, the backward locking member 340 of the backward locking mechanism 2034 is driven toward a bottom of a backward housing member 310 by receiving the pressure of the hydraulic oil from a backward retard chamber 2032*rl* between the specific vane 32*vs* among a plurality of the backward retard chamber 32*r* and the shoe 310*sa*. Along with this, in the backward locking mechanism 2034, a position where a backward locking hole 2341 in a backward cover member 311 is formed is more shifted in the advance direction than that of the backward locking hole 341 of the first embodiment.

According to the configuration, when the backward phase is reached to the backward-most advanced phase Pad as shown in FIG. 11 in a state in which pressure of the hydraulic oil from the backward retard chamber 2032*rl* decreases or extinguishes, the backward locking member 340 is fit into a backward locking hole 2341 as shown in FIG. 9 by a biasing force from a backward elastic member 342. By the fitting, the backward phase is locked at the backward-most retarded phase Pad. Whereas, when the pressure of the hydraulic oil from the backward retard chamber 2032*rl*, the backward locking member 340 separates from the backward locking hole 2341 against the biasing force from the backward elastic member 342 (not shown). By the separation, the backward phase locking at the backward-most advanced phase Pad is released.

As shown in FIG. 9, a backward biasing member 2035 is constituted by a helical spring. The backward biasing member 2035 is arranged outside the backward intermediate rotor 31 and is interposed between the backward housing member 310 and the backward shaft portion 2032*a*. The backward shaft portion 2032*a* supporting the backward biasing member 2035 is inserted into the bottom of the backward housing member 310 and is integrally rotatable with the backward body 32*b* relative to the backward housing member 310. The backward biasing member 2035 biases the backward link rotor 32 and the intake cam shaft 3 in the advance direction relative to the backward intermediate rotor 31 by applying the restoring force to the backward shaft portion 2032*a*.

According to the second embodiment, the intake cam phase changes as shown in FIGS. 8A, 8B and 8C by adjusting individually the forward phase and the backward phase as is the case with the first embodiment. However, in the second embodiment, since the control by the engine control circuit 46 as well as the operation and the effects by the control are different from those of the first embodiment, the different points will be mainly described below.

When the engine control circuit 46 outputs a command to maintain the forward retard operation or a command for the forward maintaining operation during the normal operation of the engine 1 after the forward phase is reached to the forward-most retarded phase Pru by the forward retard operation, the locking at the forward-most retarded phase Pru by the forward locking mechanism 2024 is maintained. Further, when the engine control circuit 46 outputs a command to maintain the backward advance operation or a command for the backward maintaining operation after the backward phase is reached to the backward-most advanced phase Pad during the normal operation, the locking at the backward-most advanced phase Pad by the backward locking mechanism 2034 is maintained.

During the normal operation of the second embodiment, in which the engine control circuit 46 outputs similar commands of the first embodiment except for the above-described operation by the engine control circuit 46, either one of operation states as followings (2A), (2B), (2C) or (2D) is produced.

(2A) An intake initial state in which both the locking at the forward-most retarded phase Pru by the forward locking mechanism 2024 and the locking at the backward-most advanced phase Pad by the backward locking mechanism 2034 are performed, one of the forward retard operation or the forward maintaining operation is executed, and one of the backward advance operation or the backward maintaining operation is executed.

(2B) A state in which the locking by the backward locking mechanism 2034 is released while the locking by the forward locking mechanism 2024 is maintained, and either one of the backward advance operation, the backward retard operation or the backward maintaining operation is executed.

(2C) A state in which the locking by the forward locking mechanism 2024 is released while the locking by the backward locking mechanism 2034 is maintained, and either one of the forward advance operation, the forward retard operation or the forward maintaining operation is executed.

(2D) A state in which both the locking by the forward locking mechanism 2024 and the locking by the backward locking mechanism 2034 are released, one of the forward advance operation, the forward retard operation or the forward maintaining operation is executed, and one of the backward advance operation, the backward retard operation or the backward maintaining operation is executed.

For example, when the backward phase reaches the backward-most retarded phase Prd by shifting a state from the intake initial state (2A) as shown in FIG. 8A to the state (2B) in which the backward retard operation is executed, the intake cam phase becomes the intake most retarded phase Pri as shown in FIG. 8C. In this case, by blowing-back of the intake gas as is the case with the state (1C) of the first embodiment, the fuel efficiency of the engine 1 can be improved. Further, when the forward phase reaches the forward-most advanced phase Pau by shifting a state from the initial state (2A) as shown in 8A to the state (2C) in which the forward advance operation is executed, the intake cam phase becomes the intake most advanced phase Pai as shown in FIG. 8B. In this case, by the internal EGR as is the case with the state (1B) of the first embodiment, the fuel efficiency and the environmental performance can be improved.

At a normal stop in which the engine 1 is stopped according to a stop command during the normal operation, the engine control circuit 46 according to the second embodiment outputs the forward retard operation and the backward advance operation to the switching control unit 45. As the result of the command, the forward phase is reached to the forward-most retarded phase Pru and the forward stopper mechanism 23 engages the forward intermediate rotor 22. Accordingly, the forward phase is locked at the forward-most retarded phase Pru by the forward locking mechanism 2024. Along with this, the backward phase is reached to the backward-most advanced phase Pad and the backward stopper mechanism 33 engages the intake cam shaft 3 through the backward link rotor 32. Thus, the backward phase is locked at the backward-most advanced phase Pad by the backward locking mechanism 2034.

At a normal start in which the engine 1 is started according to a start command after the normal stop, the engine control circuit 46 outputs the forward retard operation and the backward advance operation to the switching control unit 45. As the result of the command, the hydraulic oil supplied from the pump 8 is neither introduced into the forward advance chamber 2022*al* nor the backward retard chamber 2032*rl* and the pressure of the hydraulic oil to act on the forward locking member 240 and the backward locking member 340 is left substantially extinguished.

At the above-described normal start, the forward phase that is a rotational phase of the forward intermediate rotor 22 rotatable relative to the exhaust cam shaft 2, which is rotated by receiving the crank torque from the crank shaft 4, is locked at the forward-most retarded phase Pru by the forward locking mechanism 24. Along with this, at the normal start, the backward phase that is a rotational phase of the intake cam shaft 3 rotatable relative to the backward intermediate rotor 31, which is rotated in association with the forward intermediate rotor 22, is locked at the backward-most advanced phase Pad by the backward locking mechanism 34. Thus, according to each function of the forward locking mechanism 24 and the backward locking mechanism 34, the intake cam phase that is a rotational phase of the intake cam shaft 3 relative to the crank shaft 4 is locked at the intake intermediate phase Pmi, which is the combined phase of the forward-most retarded phase Pru and the backward-most advanced phase Pad. As a result, startability of the engine 1 by the intermediate phase locking can be secured.

In the second embodiment, an engine start in a backward failure state, in which the locking at the backward-most advanced phase Pad by the backward locking mechanism 2034 is released while the locking at the forward-most retarded phase Pru by the forward locking mechanism 2024 is maintained, can be assumed. For example, a case in which the engine 1 is started according to the start command after an engine stall (i.e., the engine 1 is stopped in a moment at a phase other than the intake intermediate phase Pmi) at the operation state (2B) during the normal operation can be assumed. The locking by the forward locking mechanism 2024 is maintained since, at the engine start in the backward failure state, as with the normal start, the engine control circuit 46 outputs commands for the forward retard operation and the backward advance operation to the switching control unit 45.

At the above-described start in the backward failure state, the cam torque that is biased toward the retard direction on average acts on the intake cam shaft 3. However, the backward biasing member 2035 biases the intake cam shaft 3 in the advance direction against the averaged cam torque. As a result, when the backward phase is reached to the backward-most advanced phase Pad by the biasing force from the backward biasing member 2035, the backward stopper mechanism 33 engages the intake cam shaft 3 and further advance of the backward phase is prevented. Therefore, the backward locking mechanism 2034 may easily lock, and thus the intake cam phase becomes a locked state at the intake intermediate phase Pmi, as with the normal start, and the startability by the intermediate phase locking can be secured.

Further, in the second embodiment, an engine start in a forward failure state, in which the locking at the forward-most retarded phase Pru by the forward locking mechanism 2024 is released while the locking at the backward-most advanced phase Pad by the backward locking mechanism 2034 is maintained, can be assumed. For example, a case in which the engine 1 is started according to the start command after an engine stall (i.e., the engine 1 is stopped in a moment at a phase other than the intake intermediate phase Pmi) at the operation state (2C) during the normal operation can be assumed. The locking by the backward locking mechanism 2034 is maintained since, at the engine start in the forward failure state, as with the normal start, the engine control circuit 46 outputs commands for the forward retard operation and the backward advance operation to the switching control unit 45.

At the above-described start in the backward failure state, the cam torque that is biased in the retard direction on average acts on the intake cam shaft 3 and the backward intermediate rotor 31. In this case, the cam torque biased in the retard direction on average is transmitted to the forward intermediate rotor 22 that is rotated in association with the backward intermediate rotor 31. As a result, when the forward phase is reached to the forward-most retarded phase Pru by the cam torque toward the forward intermediate rotor 22, the forward stopper mechanism 23 engages the forward intermediate rotor 22 and further retard of the forward phase is prevented. Therefore, the forward locking mechanism 2024 may easily lock, and thus the intake cam phase becomes a locked state at the intake intermediate phase Pmi, as with the normal start, and the startability by the intermediate phase locking can be secured.

Furthermore, in the second embodiment, an engine start in a forward-and-backward failure state, in which both the locking at the forward-most retarded phase Pru by the forward locking mechanism 2024 and the locking at the backward-most advanced phase Pad by the backward locking mechanism 2034 are released, can be assumed. For example, a case in which the engine 1 is started according to the start command after an engine stall (i.e., the engine 1 is stopped in a moment at a phase other than the intake intermediate phase Pmi) at the operation state (2D) during the normal operation can be assumed. The engine control circuit 46 outputs commands for the forward retard operation and the backward advance operation to the switching control unit 45 at the engine start in the forward-and-backward failure state.

At the above-described engine start in the forward-and-backward failure state, when the backward phase is reached to the backward-most advanced phase Pad by the biasing force from the backward biasing member 2035, the locking by the backward locking mechanism 2034 becomes easy according to the same principle as is the case with the backward failure state. Further, the backward biasing member 2035 biases the backward intermediate rotor 31 in the retard direction at the engine start in the forward-and-backward failure state. In this case, the biasing force from the backward biasing member 2035 is also transmitted to the forward intermediate rotor 22 that is rotated in association with the backward intermediate rotor 31. As a result, when the forward phase reaches the forward-most retarded phase Pru by the biasing force biasing the forward intermediate rotor 22, the locking by the forward locking mechanism 2024 becomes easy according to the same principle as is the case with the forward failure state. Accordingly, as with the normal start, the intake cam phase is in a locked state at the intake intermediate phase Pmi, and thus the startability by the intermediate phase locking can be secured.

Furthermore, at the engine start in the forward failure state, the forward intermediate rotor 22 receives not only the cam torque biased in the retard direction on average but also the biasing force from the forward biasing member 2025 in the retard direction. Further, at the engine start in the forward-and-backward failure state, the forward intermediate rotor 22 receives not only the biasing force from the backward biasing member 2035 in the retard direction but also biasing force from the forward biasing member 2025 in the retard direction. Accordingly, at the engine start in both the forward failure state and the forward-and-backward failure state, the forward phase can be surely reached to the forward-most retarded phase Pru. Thus, reliability for securing the startability by the intermediate phase locking can be improved.

In addition to the above, according to the second embodiment, the effects by the use of the pressure of the hydraulic oil and the effects by controlling the supply timing of the hydraulic oil for the pressure at an engine start can be provided according to the same principle as is the case with the first embodiment.

(Third Embodiment)

Figure 12:
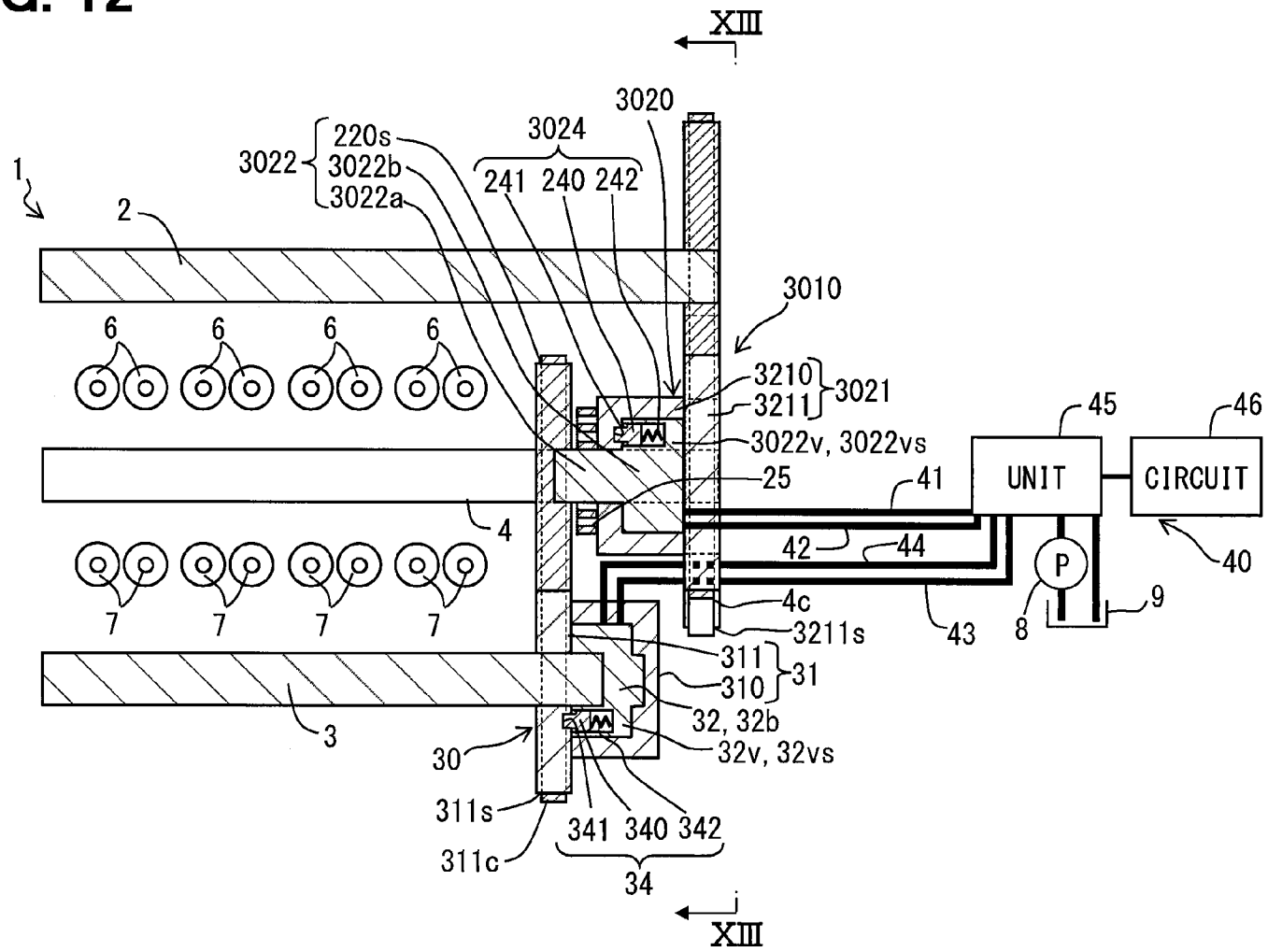
FIG. 12 is a configuration diagram taken along line XII-XII in FIGS. 13 and 14 illustrating a valve control apparatus that is mounted in an internal combustion engine according to the second embodiment.
Figure 13:
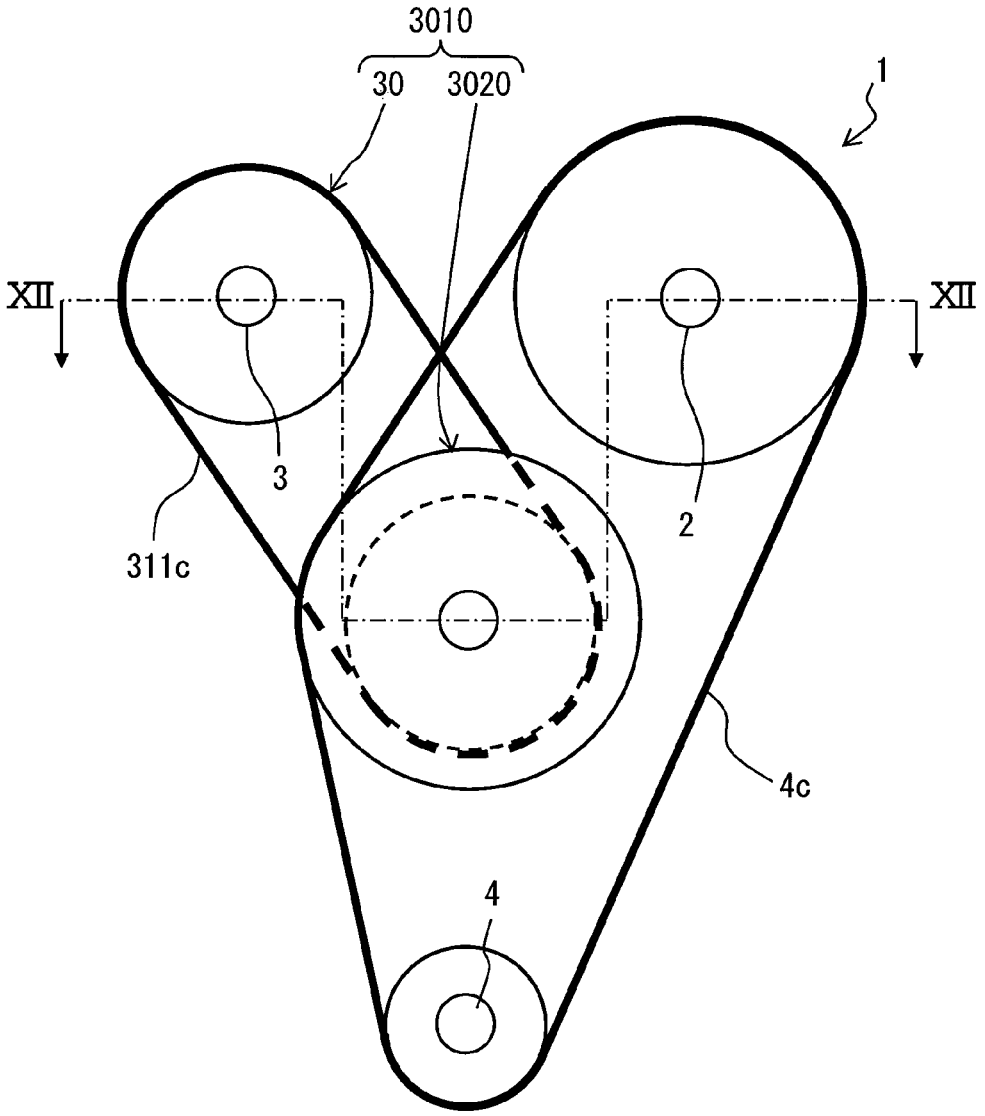
FIG. 13 is a diagram viewing from the arrow line XIII-XIII in FIG. 12.
Figure 14:
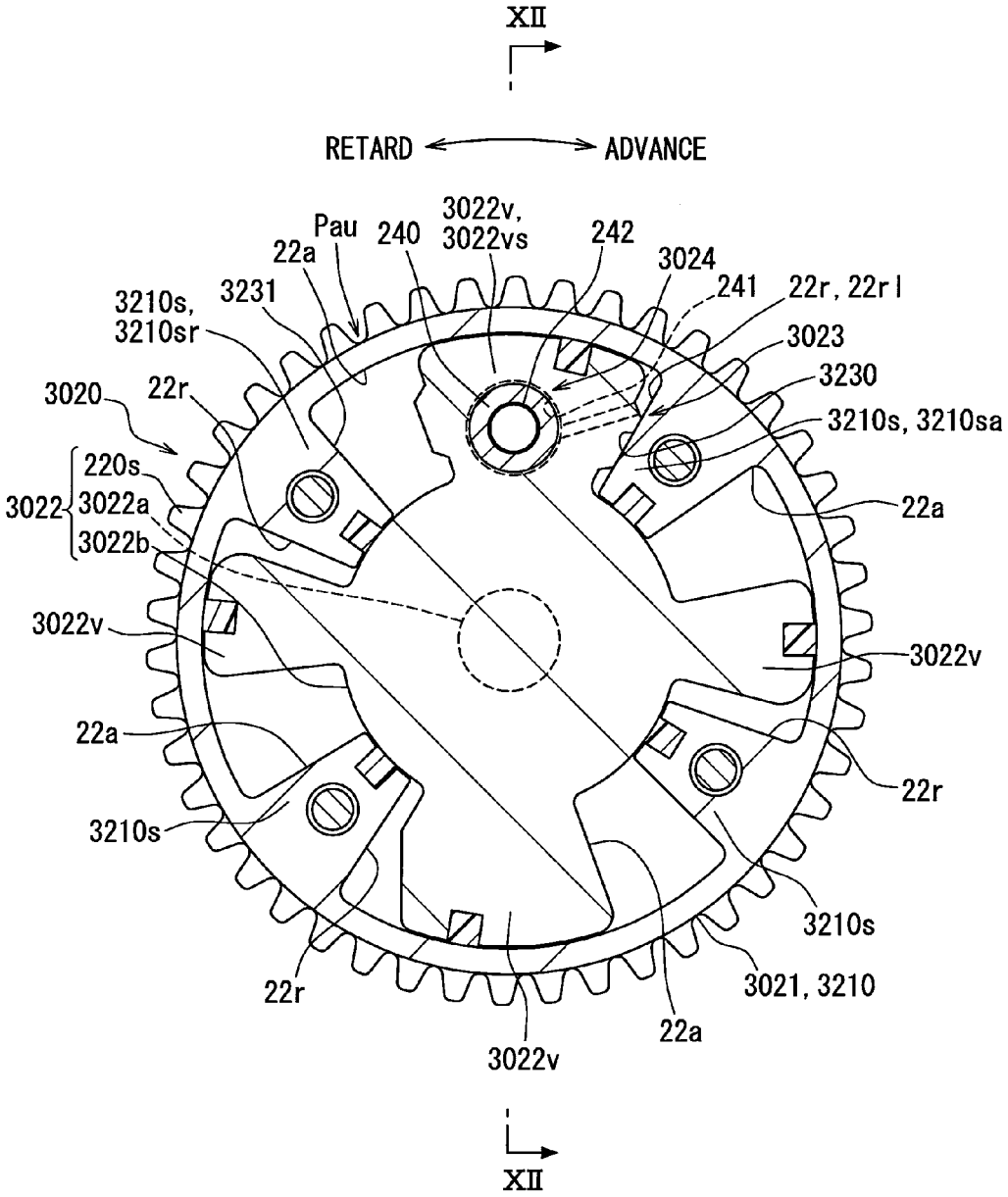
FIG. 14 is a diagram illustrating an operation of a forward phase adjustment unit in FIG. 12.

As shown in FIGS. 12 to 14, the third embodiment of the present disclosure is another modification to the first embodiment.

In a valve control apparatus 3010 of the third embodiment as shown in FIGS. 12 and 14, a forward phase adjustment unit 3020 includes a forward link rotor 3021, a forward intermediate rotor 3022, a forward stopper mechanism 3023 and a forward locking mechanism 3024, which are different components from the first embodiment.

Specifically, the forward link rotor 3021 is eccentrically arranged with respect to the exhaust cam shaft 2. The forward link rotor 3021 is formed into a hollow shape by coaxially fastening a forward housing member 3210 having a bottomed cylindrical shape to a forward cover member 3211 having an annular-plate-like shape. The forward housing member 3210 is provided with a plurality of shoes 3210*s* at given intervals in a circumferential direction. Each shoe 3210*s* protrudes from the forward housing member 3210 inwardly in a radial direction.

As shown in FIG. 12, a forward sprocket 3211*s*, which is formed into a spur gear shape, is provided entirely on an outer periphery of the forward cover member 3211. The timing chain 4*c* (refer to FIG. 13) is wound between the forward sprocket 3211*s* and each shaft 2, 4. In particular, according to the third embodiment, the timing chain 4*c* is wound at one end of the exhaust cam shaft 2 corresponding to the side of the intake cam shaft 3 to which the backward link rotor 32 is connected. Therefore, the forward link rotor 3021 is rotated together with the exhaust cam shaft 2, which is separately formed with the forward link rotor 3021, in association with the crank shaft 4 by receiving the crank torque from the crank shaft 4 through the timing chain 4*c*. In this case, the rotational direction of the forward link rotor 3021 becomes a specified circumferential direction (e.g., the clockwise direction in FIG. 14).

The forward intermediate rotor 3022 is a so-called vane rotor and is eccentrically arranged with respect to the exhaust cam shaft 2. A forward body 3022*b* of the forward intermediate rotor 3022 is housed inside a hollow space of the forward link rotor 3021. As shown in FIG. 14, a plurality of vanes 3022*v* are provided with the forward body 3022*b* at given intervals in a circumferential direction and each vane 3022*v* protrudes outwardly in a radial direction from the forward body 3022*b*. The vanes 3022*v* and the shoes 3210*s* are alternately arranged in the circumferential direction. By this arrangement, the forward advance chamber 22*a* is formed between the each vane 3022*v* and the shoe 3210*s* adjacent to the vane 3022*v* in the retard direction of the circumferential direction. Further, the forward retard chamber 22*r* is formed between each vane 3022*v* and the shoe 3210*s* adjacent to the vane 3022*v* in the advance direction of the circumferential direction.

As shown in FIG. 12, a forward shaft portion 3022*a*, which integrally rotates with the forward body 3022*b* of the forward intermediate rotor 3022, is inserted into a bottom of a forward cover member 3211 and is rotatable relative to the forward cover member 3211. The forward biasing member 25, which is interposed between the forward shaft portion 3022*a* and the forward housing member 3210, biases the forward intermediate rotor 3022 in the advance direction relative to the forward link rotor 3021 by applying a storing force to the forward shaft portion 3022*a*. In the present embodiment, the biasing torque generated to bias the forward intermediate rotor 3022 is greater than the averaged cam torque that is transmitted from the intake cam shaft 3 to the forward intermediate rotor 3022. The forward sprocket 220*s*, which is fasten to the forward body 3022*b* and the forward shaft portion 3022*a* of the forward intermediate rotor 3022, is arranged outside the forward link rotor 3021, and thus is rotatable in association with the backward sprocket 311*s*.

In the configuration, the hydraulic oil supplied from the pump 8 is introduced into and discharged from each chamber 22*a*, 22*r*. The forward intermediate rotor 3022 receives the crank torque directly from each shoe 3210*s* of the forward link rotor 3021 or through the hydraulic oil introduced into each chamber 22*a*, 22*r*. By receiving the crank torque, the forward intermediate rotor 3022 is rotated in the specified circumferential direction (e.g., the clockwise direction in FIG. 14). Further, the forward intermediate rotor 3022 is coaxially rotated relative to the forward link rotor 3021 and is eccentrically rotated relative to the exhaust cam shaft 2.

The relative rotation of the forward intermediate rotor 3022 relative to the forward link rotor 3021 generates in the advance direction by introduction of the hydraulic oil into each forward advance chamber 22*a* and discharge of the hydraulic oil from each forward retard chamber 22*r*. In this case, the forward phase, which is a rotational phase of the forward intermediate rotor 3022 relative to the crank shaft 4 in the third embodiment, is adjusted in the advance direction according to the relative rotation of the forward intermediate rotor 3022. Whereas, the relative rotation of the forward intermediate rotor 3022 relative to the forward link rotor 3021 generates in the retard direction by discharge of the hydraulic oil from each forward advance chamber 22*a* and introduction of the hydraulic oil into each forward retard chamber 22*r*. In this case, the forward phase is adjusted in the retard direction according to the relative rotation of the forward intermediate rotor 3022. Further, the relative rotation of the forward intermediate rotor 3022 relative to the forward link rotor 3021 is prevented by confining the hydraulic oil inside each chamber 22*a*, 22*r*. In this case, the forward phase is held substantially constant according to the regulation at the relative rotation position.

Figure 15:
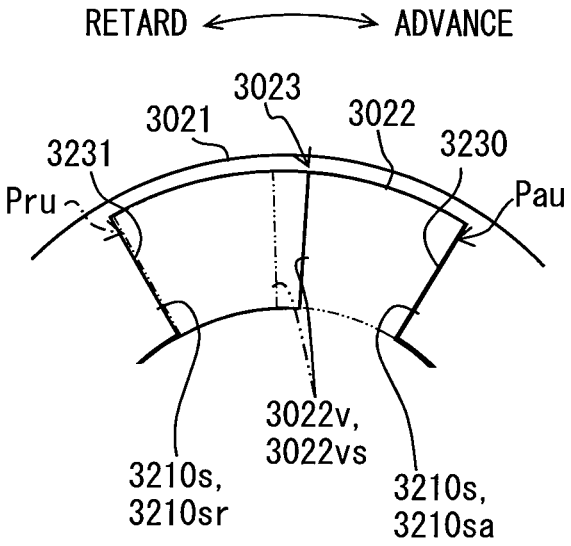
FIG. 15 is a diagram illustrating an operation of the forward phase adjustment unit in FIG. 14.

As shown in FIGS. 14 and 15, the forward stopper mechanism 3023 is constituted by combining a forward advance stopper 3230 and a forward retard stopper 3231. The forward advance stopper 3230 is defined by a shoe 3210*sa* positioned in the advance direction relative to a specific vane 3022*vs* that is one of the vanes 3022*v*. More specifically, the forward advance stopper 3230 is formed by a side of the shoe 3210*sa* that faces in the retard direction. The forward advance stopper 3230 contacts against the specific vane 3022*vs* to engage the forward intermediate rotor 3022 at the forward-most advanced phase Pau (refer to a solid line in FIGS. 14 and 15). By the engagement, the relative rotation of the forward intermediate rotor 3022 relative to the forward link rotor 3021 in the advance direction is prevented, so that further advance of the forward phase is prevented. The forward retard stopper 3231 is defined by a shoe 3210*sr* positioned in the retard direction relative to the specific vane 3022*vs*, more specifically, by a side of the shoe 3210*sr* that faces in the advance direction. The forward retard stopper 3231 contacts against the specific vane 3022*vs* to engage the forward intermediate rotor 3022 at the forward-most retarded phase Pru (refer to a two-dot line in FIG. 15). By the engagement, the relative rotation of the forward intermediate rotor 3022 relative to the forward link rotor 3021 in the retard direction is prevented, so that further retard of the forward phase is prevented.

As shown in FIGS. 12 and 14, the forward locking mechanism 3024 is constituted by combining a forward locking member 240, a forward elastic member 242 and a forward locking hole 241. The forward locking member 240 and the forward elastic member 242 are supported by the specific vane 3022*vs*, and the forward locking hole 241 is formed on an inner surface of a bottom of the forward housing member 3210. The forward locking member 240 is driven toward the forward cover member 3211 by receiving pressure of the hydraulic oil from the forward retard chamber 22*rl* between the specific vane 3022*vs* and the shoe 3210*sa*. The forward locking member 240 is biased toward the bottom of the forward housing member 3210 by receiving restoring force of the forward elastic member 242. Accordingly, when the forward phase is reached to the forward-most advanced phase Pau in a state in which the pressure of the hydraulic oil from the forward retard chamber 22*rl* decreases or extinguishes as shown in FIG. 14, the forward locking member 240 is inserted into the forward locking hole 241 by the biasing force from the forward elastic member 242 as shown in FIG. 12. Another configuration except for the above is similar to that of the forward locking mechanism 24 of the first embodiment.

According the third embodiment, the engine control circuit 46 executes the control as described in the first embodiment, and thus the operation (e.g., refer to FIG. 8) and the effects by the control, which are equivalent or corresponding to those of the first embodiment, are attained. It should be noted that the operation and the effects that are equivalent or corresponding to those of the first embodiment are provided by replacing the referential numerals 21, 22, 23 and 24 in the description for the operation in the first embodiment with the referential numerals 3021, 3022, 3023 and 3024, except for the effects by the use of the pressure of the hydraulic oil.

Regarding the operation and the effects by the use of the pressure of the hydraulic oil in the third embodiment, the forward intermediate rotor 3022 is rotated relative to the forward link rotor 3021, which rotates together with the separately-formed exhaust cam shaft 2 in association with the crank shaft 4, by the pressure of the hydraulic oil from the pump 8. Therefore, the forward phase is adjusted according to the relative rotation. Furthermore, in the third embodiment, as with the first embodiment, the backward link rotor 32, which rotates in association with the integrally-formed intake cam shaft 3, is rotated relative to the backward intermediate rotor 31 by the pressure of the hydraulic oil from the pump 8. Thus, the backward phase is adjusted according to the relative rotation. Accordingly, in the third embodiment in which the forward phase and the backward phase are adjusted using the pressure of the hydraulic oil, a variable responsiveness of the intake cam phase, which is the combined phase of the forward phase and the backward phase, can be secured during the normal operation, and the startability by the intermediate phase locking can be also secured at the engine start.

(Fourth Embodiment)

Figure 16:
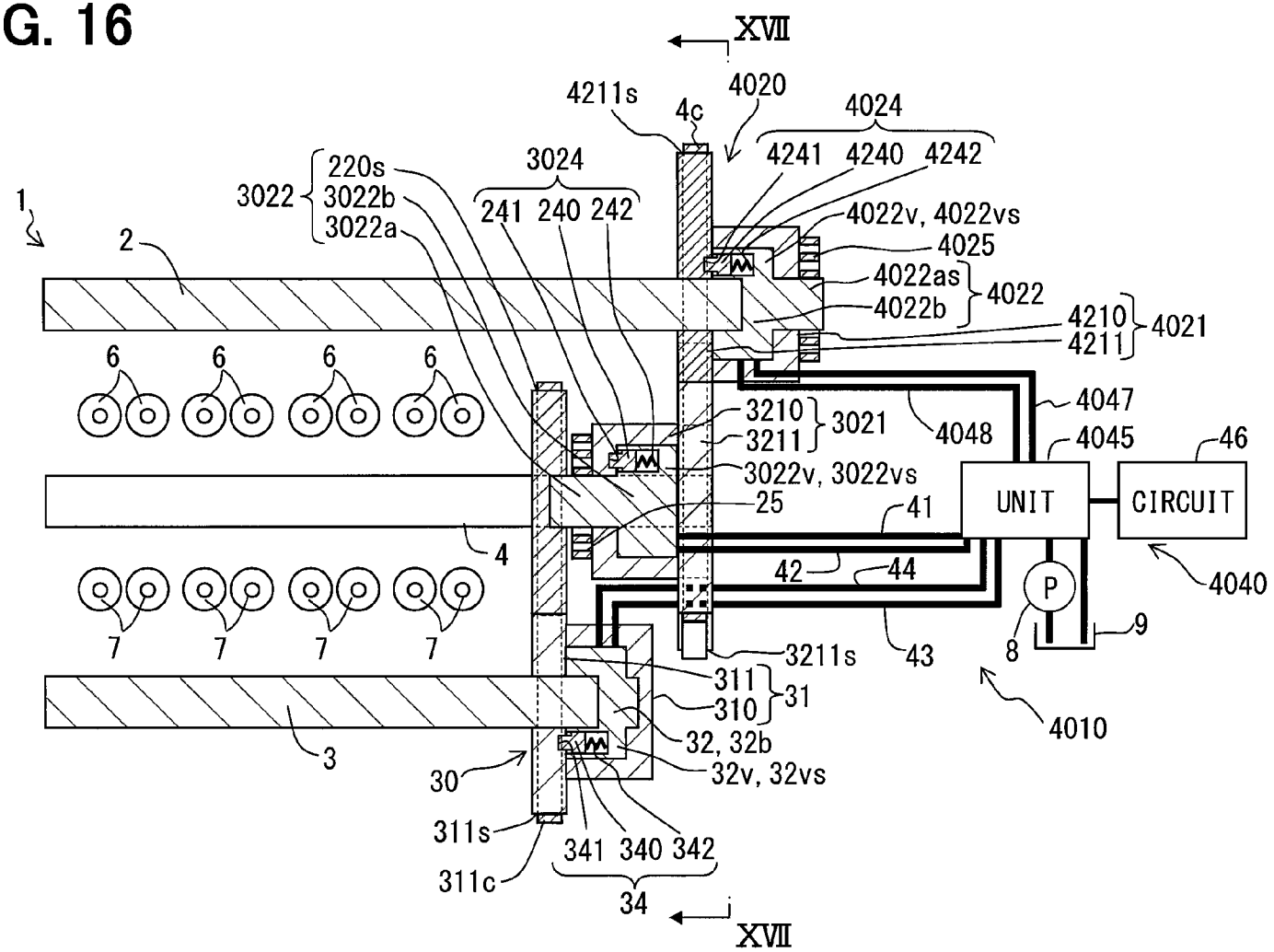
FIG. 16 is a configuration diagram taken along line XVI-XVI in FIGS. 17 and 18 illustrating a valve control apparatus that is mounted in an internal combustion engine according to a fourth embodiment.
Figure 17:
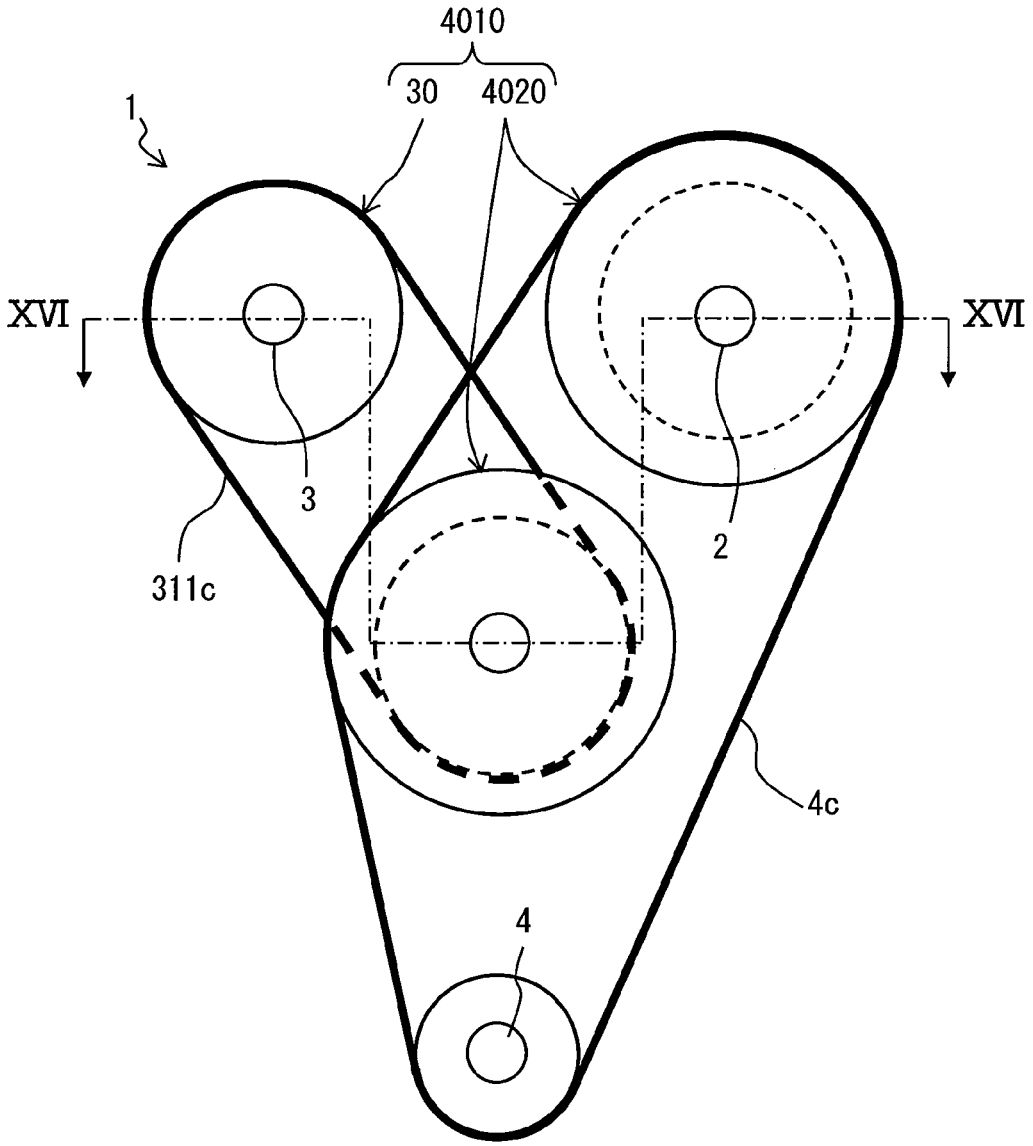
FIG. 17 is a diagram viewing from an arrow line XVII-XVII in FIG. 16.

As shown in FIGS. 16 and 17, the fourth embodiment of the present disclosure is a modification to the third embodiment.

A valve control apparatus 4010 of the fourth embodiment, the exhaust cam phase is made variable along with the intake cam phase so that valve timing of both the intake valve 7 and the exhaust valve 6 can be controlled. The valve control apparatus 4010 controls each valve timing of the intake valve 7 and the exhaust valve 6 independently using the pressure of the hydraulic oil from the drain pan 9 to the pump 8.

Figure 18:
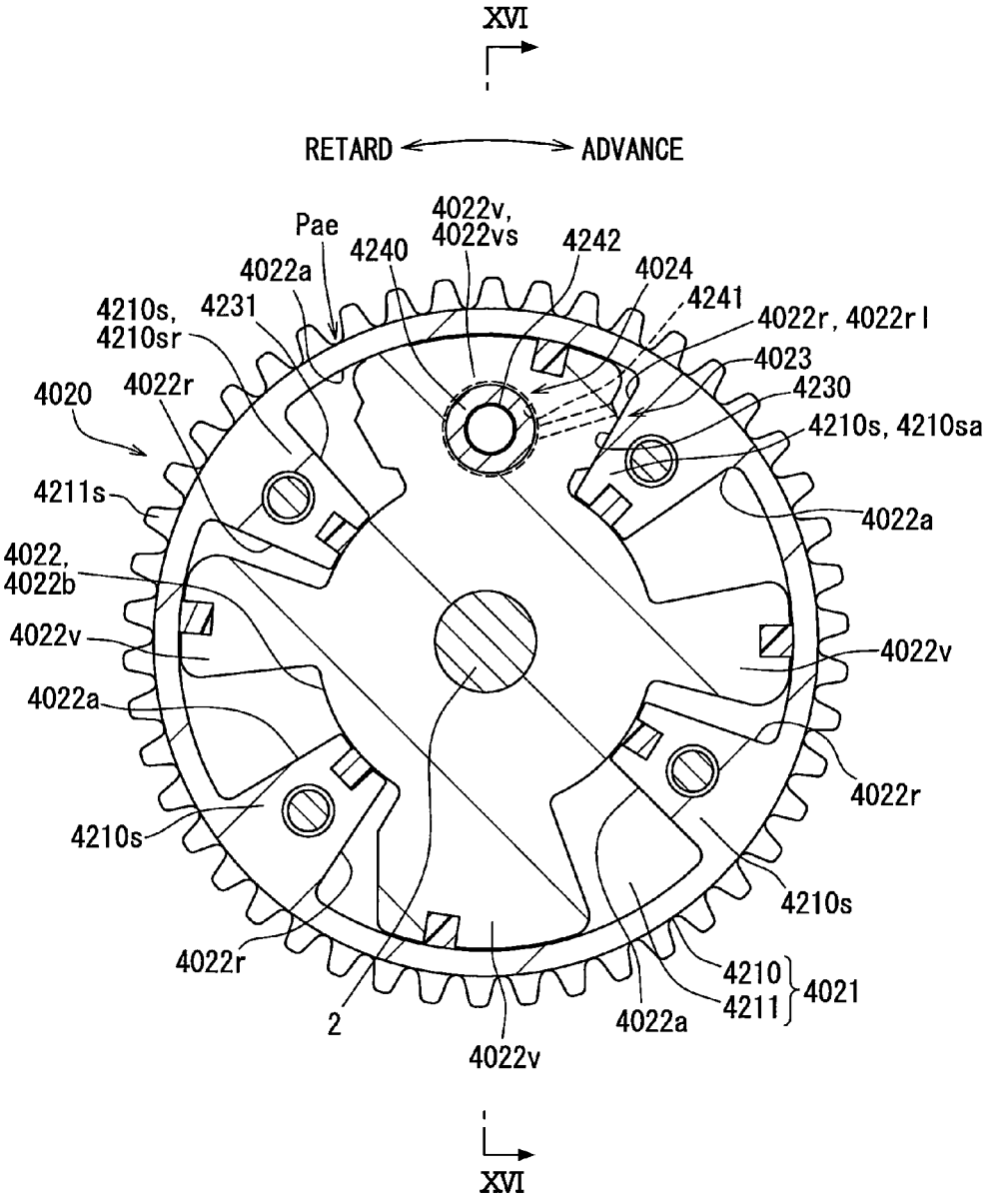
FIG. 18 is a cross-sectional view illustrating a portion of the forward phase adjustment unit in FIG. 16.

As shown in FIGS. 16 and 18, a forward phase adjustment unit 4020 of the valve control apparatus 4010 further includes an exhaust link rotor 4021, an exhaust intermediate rotor 4022, an exhaust stopper mechanism 4023, an exhaust locking mechanism 4024 and an exhaust biasing member 4025.

An exhaust link rotor 4021 is coaxially arranged with the exhaust cam shaft 2. The exhaust link rotor 4021 is formed into a hollow shape by coaxially fastening an exhaust housing member 4210 having a bottomed cylindrical shape to an exhaust cover member 4211 having an annular-plate-like shape. The exhaust housing member 4210 is provided with a plurality of shoes 4210*s* at given intervals in the circumferential direction and each shoe 4210*s* protrudes inwardly in the radial direction. The exhaust cam shaft 2 formed separately with the exhaust cover member 4211 is inserted into the exhaust cover member 4211 and is rotatable relative to the exhaust cover member 4211. An exhaust sprocket 4211*s*, which is formed into a spur gear shape, is provided entirely on an outer periphery of the exhaust cover member 4211. The timing chain 4*c* (refer to FIG. 17) is wound between the exhaust sprocket 4211*s*, the forward sprocket 3211*s* and the crank shaft 4. The exhaust link rotor 4021 is rotated together with the forward link rotor 3021 in association with the crank shaft 4. In this case, the rotational direction of the exhaust link rotor 4021 becomes a specified circumferential direction (e.g., a clockwise direction in FIG. 18).

The exhaust intermediate rotor 4022 is a so-called vane rotor and is coaxial with the exhaust cam shaft 2. An exhaust body 4022*b* of the exhaust intermediate rotor 4022 is housed inside a hollow space of the exhaust link rotor 4021. The exhaust body 4022*b* is connected to one end of the exhaust cam shaft 2 corresponding to the side of the intake cam shaft 3 to which the backward link rotor 32 is connected. By this connection, the exhaust intermediate rotor 4022 is rotated in association with the exhaust cam shaft 2, which is integrally formed with the exhaust intermediate rotor 4022, by receiving the crank torque, as described below. In this case, the rotational directions of the exhaust intermediate rotor 4022 and the exhaust cam shaft 2 become the specified circumferential direction (e.g., the clockwise direction in FIG. 18).

As shown in FIG. 18, the exhaust body 4022*b* is provided with a plurality of vanes 4022*v* at given intervals in a circumferential direction. Each vane 4022*v* protrudes outwardly in a radial direction. The vanes 4022*v* and the shoes 4210*s* are positioned alternately in the circumferential direction. An exhaust advance chamber 4022*a* is defined between each vane 4022*v* and the shoe 4210*s* adjacent to the vane 4022*v* in the retard direction of the circumferential direction. Further, an exhaust retard chamber 4022*r* is defined between each vane 4022*v* and the shoe 4210*s* adjacent to the vane 4022*v* in the advance direction of the circumferential direction.

In the configuration, the hydraulic oil supplied from the pump 8 is introduced into and discharged from each chamber 4022*a*, 4022*r*. The exhaust intermediate rotor 4022 receives the crank torque directly from each shoe 4210*s* of the exhaust link rotor 4021 or through the hydraulic oil introduced into each chamber 4022*a*, 4022*r*. By the crank torque, the exhaust intermediate rotor 4022 is rotated in association with the exhaust cam shaft 2 and is coaxially rotated relative to the exhaust link rotor 4021.

The relative rotation of the exhaust intermediate rotor 4022 relative to the exhaust link rotor 4021 generates in the advance direction by the introduction of the hydraulic oil into each exhaust advance chamber 4022*a* and the discharge of the hydraulic oil from each exhaust retard chamber 4022*r*. In this case, since the relative rotation of the exhaust cam shaft 2 relative to the exhaust link rotor 4021 also generates in the advance direction, the exhaust cam phase, which is the rotational phase of the exhaust cam shaft 2 relative to the crank shaft 4, is adjusted in the advance direction according to relative rotation. Whereas, the relative rotation of the exhaust intermediate rotor 4022 relative to the exhaust link rotor 4021 generates in the retard direction by the discharge of the hydraulic oil from each exhaust advance chamber 4022*a* and the introduction of the hydraulic oil into each exhaust retard chamber 4022*r*. In this case, since the relative rotation of the exhaust cam shaft 2 relative to the exhaust link rotor 4021 also generates in the retard direction, the exhaust cam phase is adjusted in the retard direction according to the relative rotation. Whereas, by confining the hydraulic oil inside each chamber 4022*a*, 4022*r*, the relative rotation of the exhaust intermediate rotor 4022 relative to the exhaust link rotor 4021 is prevented. Further, since the relative rotation of the exhaust cam shaft 2 relative to the exhaust link rotor 4021 is also prevented, the exhaust cam phase is held substantially constant according to the regulation at the relative rotation position.

Figure 19:
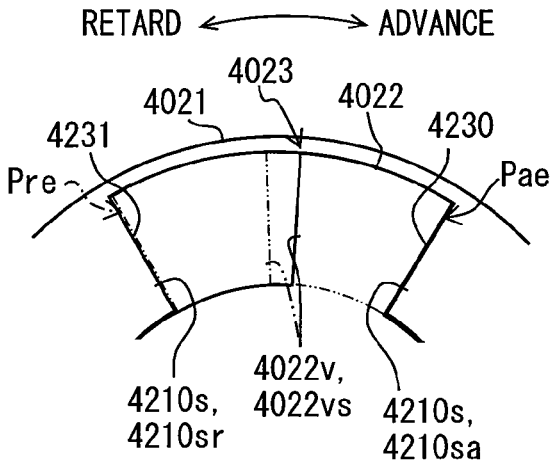
FIG. 19 is a diagram illustrating an operation of the forward phase adjustment unit in FIG. 18.

As shown in FIGS. 18 and 19, an exhaust stopper mechanism 4023 is constituted by combining an exhaust advance stopper 4230 and an exhaust retard stopper 4231. The exhaust advance stopper 4230 is formed by the shoe 4210*sa* positioned in the advance direction relative to a specific vane 4022*vs* that is one of the plurality of the vanes 4022*v*, more specifically, is formed by a side of the shoe 4210*sa* which faces in the retard direction. The exhaust advance stopper 4230 engages the exhaust intermediate rotor 4022 at an exhaust most advanced phase Pae (refer to a solid line in FIGS. 18 and 19) by contacting on the specific vane 4022*vs*. Thus, the relative rotation of the exhaust intermediate rotor 4022 relative to the exhaust link rotor 4021 in the advance direction is prevented, so that the further advance of the exhaust cam phase is prevented. The exhaust retard stopper 4231 is formed by the shoe 4210*sr* positioned in the retard direction relative to the specific vane 4022*vs*, more specifically, is formed by a side of the shoe 4210*sr* that faces in the advance direction. The exhaust retard stopper 4231 engages the specific vane 4022*vs* at an exhaust most retarded phase Pre (see a two-dot line in FIG. 19) by contacting on the specific vane 4022*vs*. Thus, the relative rotation of the exhaust intermediate rotor 4022 relative to the exhaust link rotor 4021 is prevented, so that the further retard of the exhaust cam phase is prevented.

As shown in FIGS. 16 and 18, an exhaust locking mechanism 4024 is constituted by combining an exhaust locking member 4240, an exhaust locking hole 4241 and an exhaust elastic member 4242. The exhaust locking member 4240 having a bottomed cylindrical shape is supported by the specific vane 4022*vs* and is capable of reciprocating in an axial direction of the exhaust intermediate rotor 4022. The exhaust locking member 4240 is driven toward a bottom of the exhaust housing member 4210 by receiving the pressure of the hydraulic oil from the exhaust retard chamber 4022*rl* between the specific vane 4022*vs* and the shoe 4210*sa*.

The exhaust locking hole 4241 having a cylindrical hole shape is formed on an inner surface of the exhaust cover member 4211. The exhaust elastic member 4242, which is a coil spring, is supported by the specific vane 4022*vs*. The exhaust elastic member 4242 biases the exhaust locking member 4240 toward the exhaust cover member 4211 by applying a storing force to the exhaust locking member 4240. Thus, when the exhaust cam phase is reached to the exhaust most advanced phase Pae as shown in FIG. 18 in a state in which the pressure of the hydraulic oil from the exhaust retard chamber 4022*rl* decreases or extinguishes, the exhaust locking member 4240 is fitted into the exhaust locking hole 4241 as shown in FIG. 16 by biasing force from the exhaust elastic member 4242. By the fitting, the exhaust cam phase is locked at the exhaust most advanced phase Pae. Whereas, when the pressure of the hydraulic oil from the exhaust retard chamber 4022*rl* increases, the exhaust locking member 4240 is separated from the exhaust locking hole 4241 against the biasing force from the exhaust elastic member 4242. By the separation, the locking of the exhaust cam phase at the exhaust most advanced phase Pae is released.

As shown in FIG. 16, the exhaust biasing member 4025, which is a helical spring, is arranged outside the exhaust link rotor 4021 and is interposed between the exhaust housing member 4210 and an exhaust shaft portion 4022*as*. The exhaust shaft portion 4022*as* receiving the exhaust biasing member 4025 is rotated in association with the exhaust body 4022*b* as a portion of the exhaust intermediate rotor 4022, which is inserted into the bottom of the exhaust housing member 4210 and is rotatable relative to the exhaust housing member 4210. The exhaust biasing member 4025 biases the exhaust intermediate rotor 4022 and the exhaust cam shaft 2 in the advance direction relative to the exhaust link rotor 4021 by applying the restoring force to the exhaust shaft portion 4022*as*. In the present embodiment, the biasing torque biasing the exhaust intermediate rotor 4022 and the exhaust cam shaft 2 is greater than the averaged cam torque transmitted from the exhaust cam shaft 2 to the exhaust intermediate rotor 4022.

As shown in FIG. 16, a control system 4040 includes an exhaust advance passage 4047, the exhaust retard passage 4048 and a switching control unit 4045 that has a configuration different from that of the first embodiment. The exhaust advance passage 4047 is communicated with each exhaust advance chamber 4022*a*. The exhaust retard passage 4048 is communicated with each exhaust retard chamber 4022*r*.

The switching control unit 4045 is constituted with a single or a plurality of electromagnetic-type direction control valves and is communicated with the exhaust advance passage 4047 and the exhaust retard passage 4048 in addition to the elements 41, 42, 43, 44, 8 and 9. The switching control unit 4045 controls to switch the communication of each passage 41, 42, 43, 44, 4047, 4048 to the pump 8 and the drain pan 9.

It should be noted that a forward advance operation for the forward phase adjustment unit 4020, a forward retard operation, a forward maintaining operation, a backward advance operation for a backward phase adjustment unit 30, a backward retard operation and a backward maintaining operation are the same as those as described in the first embodiment.

Further, the switching control unit 4045 executes an exhaust advance operation for the forward phase adjustment unit 4020. In the exhaust advance operation, the switching control unit 4045 controls the exhaust advance passage 4047 to communicate with the pump 8 and controls the exhaust retard passage 4048 to communicate with the drain pan 9. As the result of the exhaust advance operation, the hydraulic oil is introduced into each exhaust advance chamber 4022*a* and is discharged from each exhaust retard chamber 4022*r*, and thus the exhaust cam phase is advanced. Further, the switching control unit 4045 executes an exhaust retard operation for the forward phase adjustment unit 4020. In the exhaust retard operation, the switching control unit 4045 controls the exhaust advance passage 4047 to communicate with the drain pan 9 and controls the exhaust retard passage 4048 to communicate with the pump 8. As the result of the exhaust retard operation, the hydraulic oil is discharged from each exhaust advance chamber 4022*a* and is introduced into each exhaust retard chamber 4022*r*, and then the exhaust cam phase is retarded. Furthermore, the switching control unit 4045 executes an exhaust maintaining operation for the forward phase adjustment unit 4020. In the exhaust maintaining operation, the switching control unit 4045 controls both the exhaust advance passage 4047 and the exhaust retard passage 4048 to shut off the communication with both the pump 8 and the drain pan 9. As the result of the exhaust maintaining operation, the hydraulic oil is confined within each chamber 4022*a*, 4022*r*, and thus the exhaust cam phase is maintained.

Therefore, the exhaust cam phase is adjusted individually with respect to the forward phase and the backward phase, and thus changes as shown in FIGS. 20A, 20B, 20C and 20D, for example.

Figure 20A:
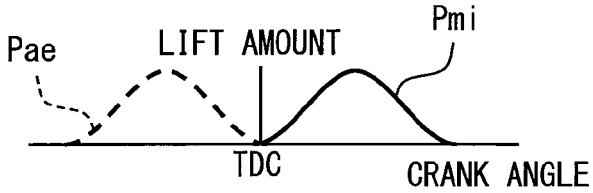
FIG. 20A is a characteristic diagram illustrating the valve control apparatus according to the first to fourth embodiments.
Figure 20B:
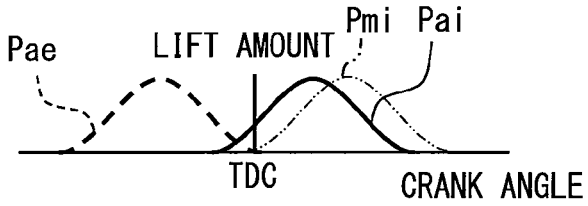
FIG. 20B is a characteristic diagram illustrating the valve control apparatus according to the first to fourth embodiments.
Figure 20C:
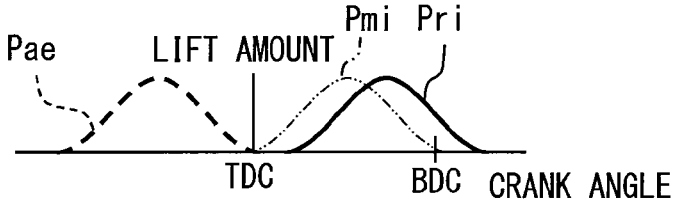
FIG. 20C is a characteristic diagram illustrating the valve control apparatus according to the first to fourth embodiments.
Figure 20D:
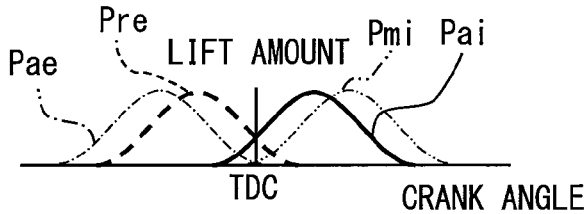
FIG. 20D is a characteristic diagram illustrating the valve control apparatus according to the first to fourth embodiments.

More specifically, in FIG. 20A, a solid line represents the intake cam phase when adjusted at the intake intermediate phase Pmi as with FIG. 8A, and a broken line represents the exhaust cam phase when adjusted at the exhaust most advanced phase Pae. In FIG. 20B, a solid line represents the intake cam phase when adjusted at the intake most advanced phase Pai as with FIG. 8B, and a broken line represents the exhaust cam phase when adjusted at the exhaust most advanced phase Pae. In FIG. 20C, a solid line represents the intake cam phase when adjusted at the intake most retarded phase Pri as with FIG. 8C, and a broken line represents the exhaust cam phase when adjusted at the exhaust most advanced phase Pae. In FIG. 20D, a solid line represents the intake cam phase when adjusted at the intake most advanced phase Pai as with FIG. 8B, and a broken line represents the exhaust cam phase when adjusted at the exhaust most retarded phase Pre. A one-dot dashed line in FIG. 20D represents the exhaust most advanced phase Pae for comparison.

Since the control by the engine control circuit 46 and the operation and the effects by the control in the fourth embodiment are different from those in the third embodiment, the different parts will be mainly described below.

In regard to the forward phase adjustment unit 4020, the engine control circuit 46 outputs (i) a command for either one of the forward advance operation, the forward retard operation or the forward maintaining operation and (ii) a command for either one of the exhaust advance operation, the exhaust retard operation or the exhaust maintaining operation to the switching control unit 4045 during the normal operation of the engine 1. In particular, when a command to maintain the exhaust advance operation or a command for the exhaust maintaining operation is output after the exhaust cam phase is reached to the exhaust most advanced phase Pae by the exhaust advance operation, the locking at the exhaust most advanced phase Pae by the exhaust locking mechanism 4024 is maintained. Further, in regard to the backward phase adjustment unit 30, the engine control circuit 46 outputs the same commands as described in the first embodiment during the normal operation of the engine 1.

According to the above-described control, either one of the following operation states (3A) and (3B) combined with either one of the operations states (1A), (1B), (1C) or (1D) as described in the first embodiment are produced during the normal operation.

(3A) An exhaust initial state in which the locking at the exhaust most advanced phase Pae by the exhaust locking mechanism 4024 is performed, and either one of the exhaust advance operation or the exhaust maintaining operation is executed.

(3B) An exhaust initial state in which the locking at the exhaust most advanced phase Pae by the exhaust locking mechanism 4024 is released, and either one of the exhaust advance operation, the exhaust retard operation or the exhaust maintaining operation is executed.

For example, FIG. 20A corresponds to the intake initial state (1A) and the exhaust initial state (3A). When shifting the initial states (1A) and (3A) to the state (1B), in which the backward advance operation is execute, and the state (3B), in which the exhaust retard operation is executed, the intake cam phase becomes the intake most advanced phase Pai and the exhaust cam phase becomes the exhaust most retarded phase Pre as shown in FIG. 20D. In this case, the intake valve 7 is opened before timing when the piston within each cylinder reaches a top dead center TDC, and then the exhaust valve 6 is closed after the timing. As a result, when the engine 1 is in a middle load region, for example, a large quantity of exhaust gas is introduced into each cylinder through an exhaust port opened by the exhaust valve 6 according to a lift amount of the piston, which is moving up for the top dead center TDC. That is, by increasing so-called internal EGR, pumping loss and nitrogen oxides (NOx) in the exhaust gas can be reduced, and thus fuel efficiency and environmental performance can be improved.

At the normal stop after the normal operation and a subsequent normal start as well as a start in each failure state, the engine control circuit 46 outputs the command for the exhaust advance operation to the switching control unit 4045 along with the commands for the forward advance operation and the backward retard operation. As the result of the commands, the hydraulic oil supplied from the pump 8 is not introduced to the forward retard chamber 22*rl*, the backward advance chamber 32*al* and the exhaust retard chamber 4022*rl*. Therefore, as with the pressure of the hydraulic oil acting on the forward locking member 240 and the backward locking member 340, the pressure of the hydraulic oil acting on the exhaust locking member 4240 also substantially extinguishes. Thus, the operation and the effects, which are the same as those of the third embodiment, can be attained in a state in which the exhaust cam phase is locked at the exhaust most advanced phase Pae by the exhaust locking mechanism 4024.

Furthermore, in the fourth embodiment, the separately-formed exhaust cam shaft 2 is rotated by the pressure of the hydraulic oil from the pump 8 relative to the exhaust link rotor 4021, which is rotated together with the forward link rotor 3021 in association with the crank shaft 4. Therefore, the exhaust cam phase as the rotational phase of the exhaust cam shaft 2, which is adjusted relative to the crank shaft 4, can be independently adjusted according to the relative rotation with respect to the forward phase, which is the relative phase of the forward intermediate rotor 3022 relative to the forward link rotor 3021. Further, the exhaust cam phase can be adjusted independently with respect to the backward phase, which is the rotational phase of the intake cam shaft 3 relative to the backward intermediate rotor 31, under the rotation of the backward intermediate rotor 31 in association with the forward intermediate rotor 3022. According to the above configuration, regarding the intake cam phase as the combined phase of the forward phase and the backward phase in which the startability by the intermediate phase locking can be secured at an engine start (i.e., a start time of the engine 1), the engine performance can be improved by controlling relation between the intake cam phase and the exhaust cam phase during the normal operation.

(Other Embodiments)

The plurality of embodiments are described above, but the present invention is not limited to the embodiments. Various modifications and combinations thereof can be applied insofar as the embodiments and the combinations do not depart from the scope of the present invention.

Figure 21:
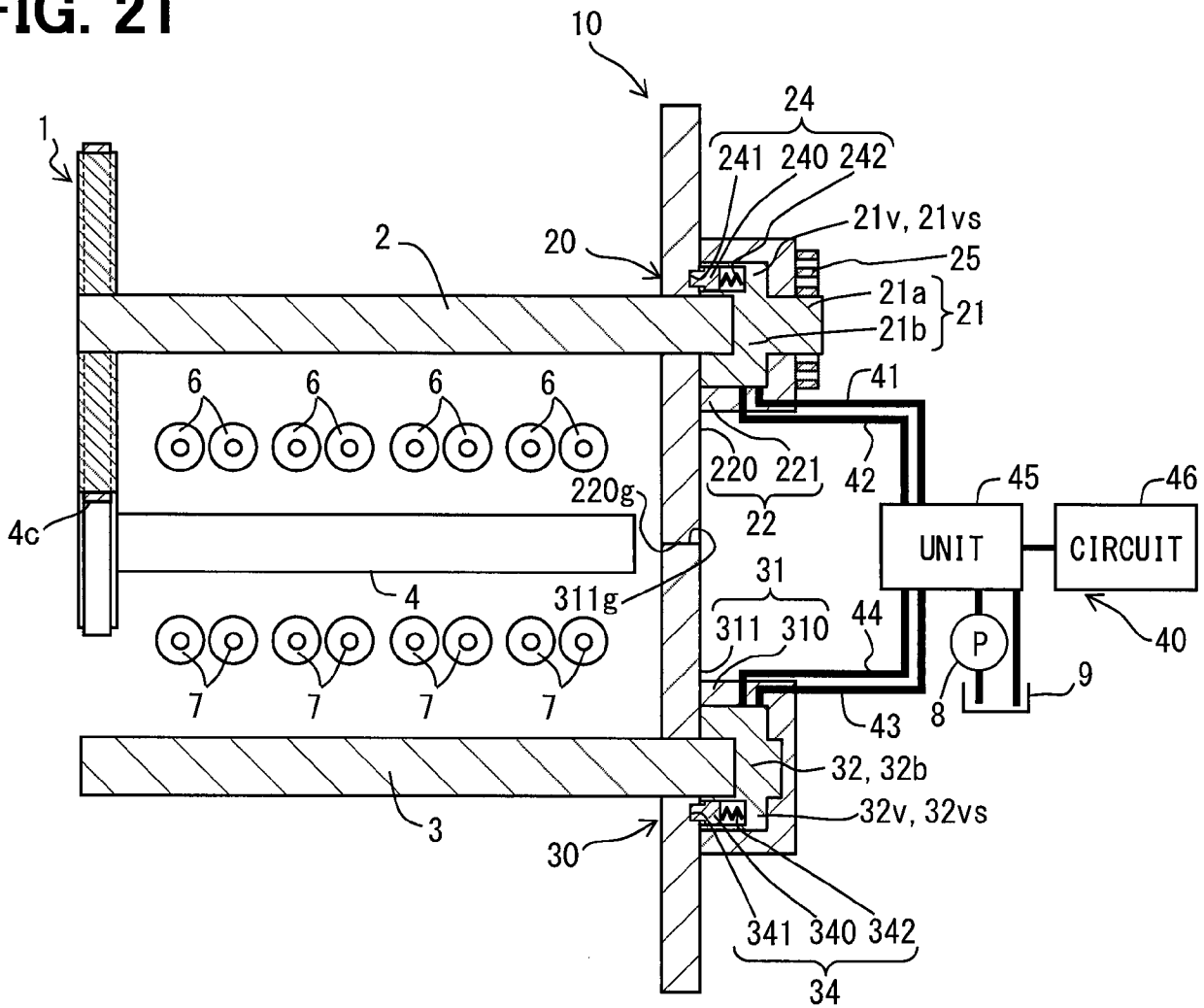
FIG. 21 is a configuration diagram according to a modification to the first embodiment as shown in FIG. 1.

In a first modification to the first to fourth embodiments, a timing belt instead of the timing chains 4*c*, 311*c* and a pulley instead of the sprockets 220*s*, 311*s*, 3211*s* and 4211*s* may be used. In a second modification to the first to fourth embodiments, gear portions 220*g*, 311*g* engaging each other as shown in FIG. 21 may be used instead of the sprockets 220*s*, 311*s*.

Figure 22:
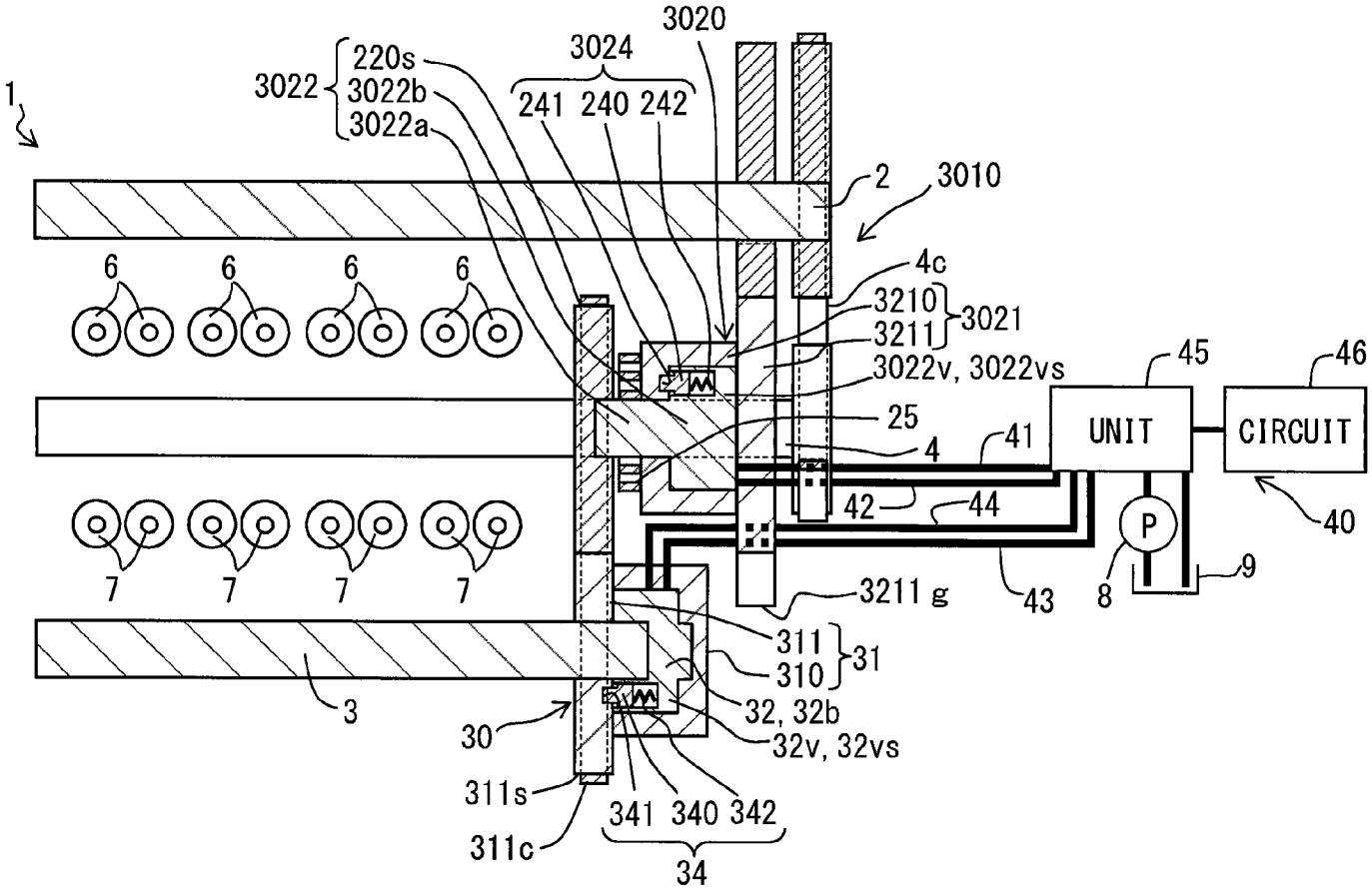
FIG. 22 is a configuration diagram according to a modification to the third embodiment as shown in FIG. 12.
Figure 23:
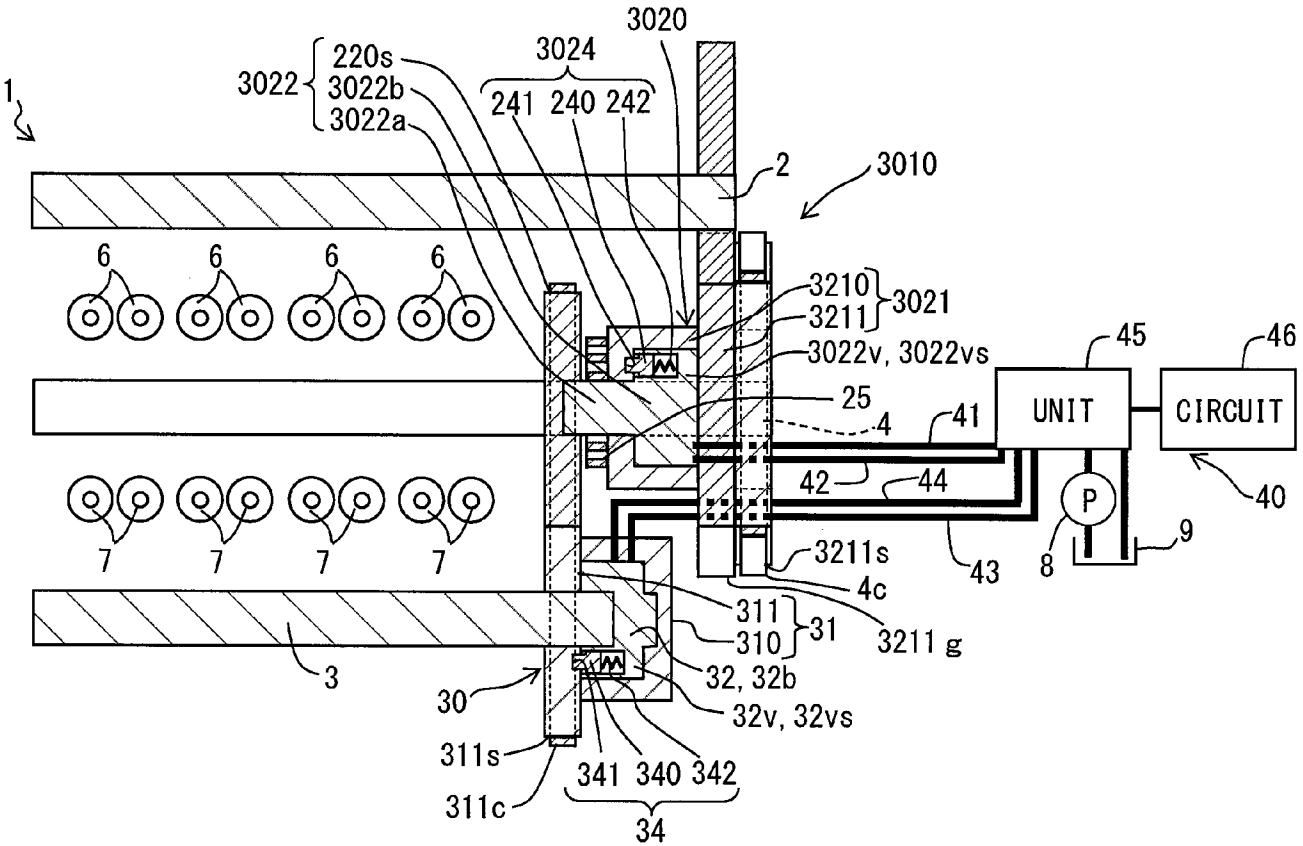
FIG. 23 is a configuration diagram according to another modification to the third embodiment as shown in FIG. 12.

As shown in FIGS. 22 and 23, in a third modification to the third embodiment, the forward link rotor 3021 may have a forward gear 3211*g* engaging the exhaust cam shaft 2. In this case, as shown in FIG. 22, the timing chain 4*c* may be wound between only the exhaust cam shaft 2 and the crank shaft 4 and the forward sprocket 3211*s* may be omitted. Further, as shown in FIG. 23, the forward sprocket 3211*s* together with the forward gear 3211*g* may be provided, and the timing chain 4*c* may be wound between only the forward sprocket 3211*s* and the crank shaft 4.

Figure 24:
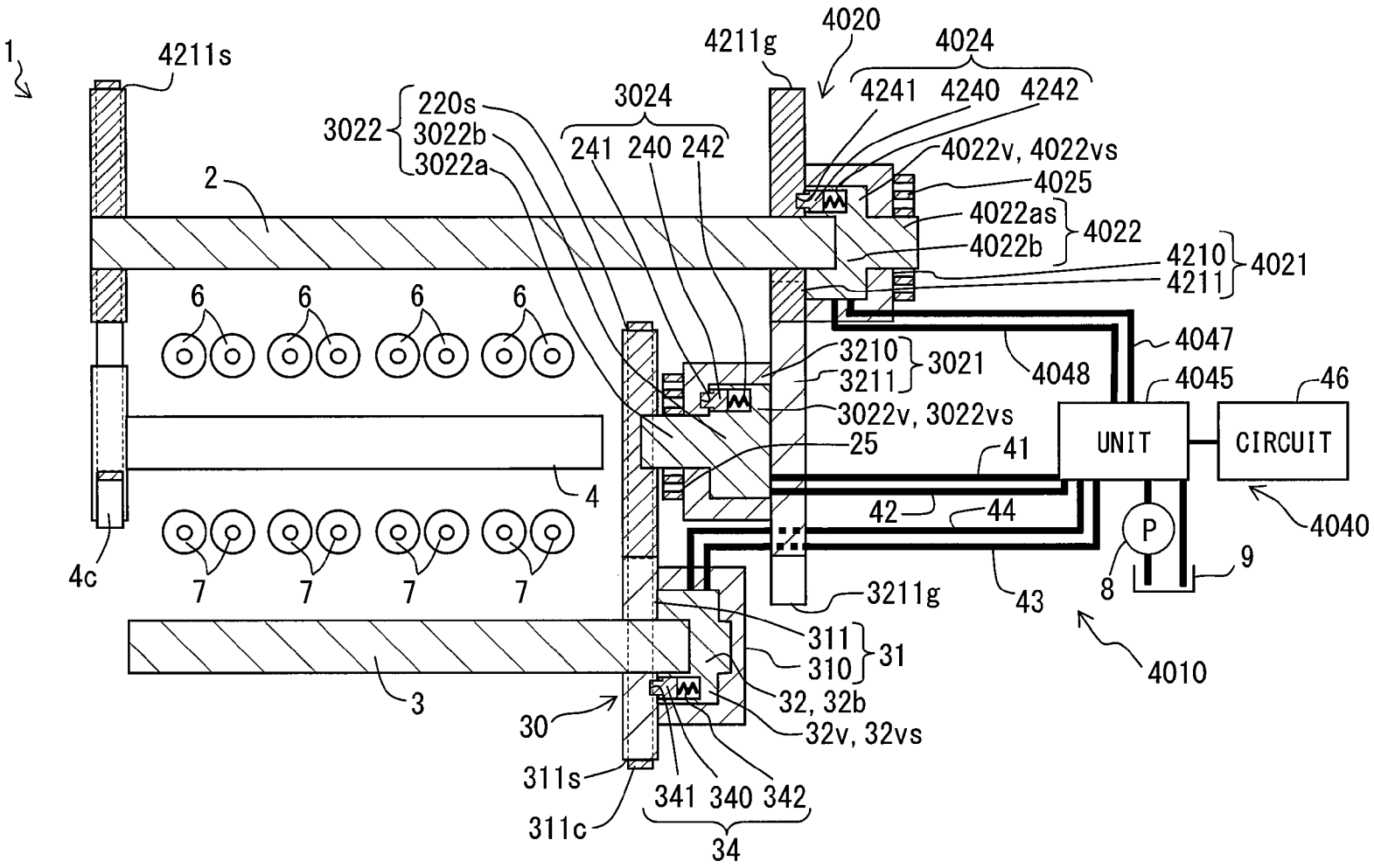
FIG. 24 is a configuration diagram according to a modification to the fourth embodiment as shown in FIG. 16.
Figure 25:
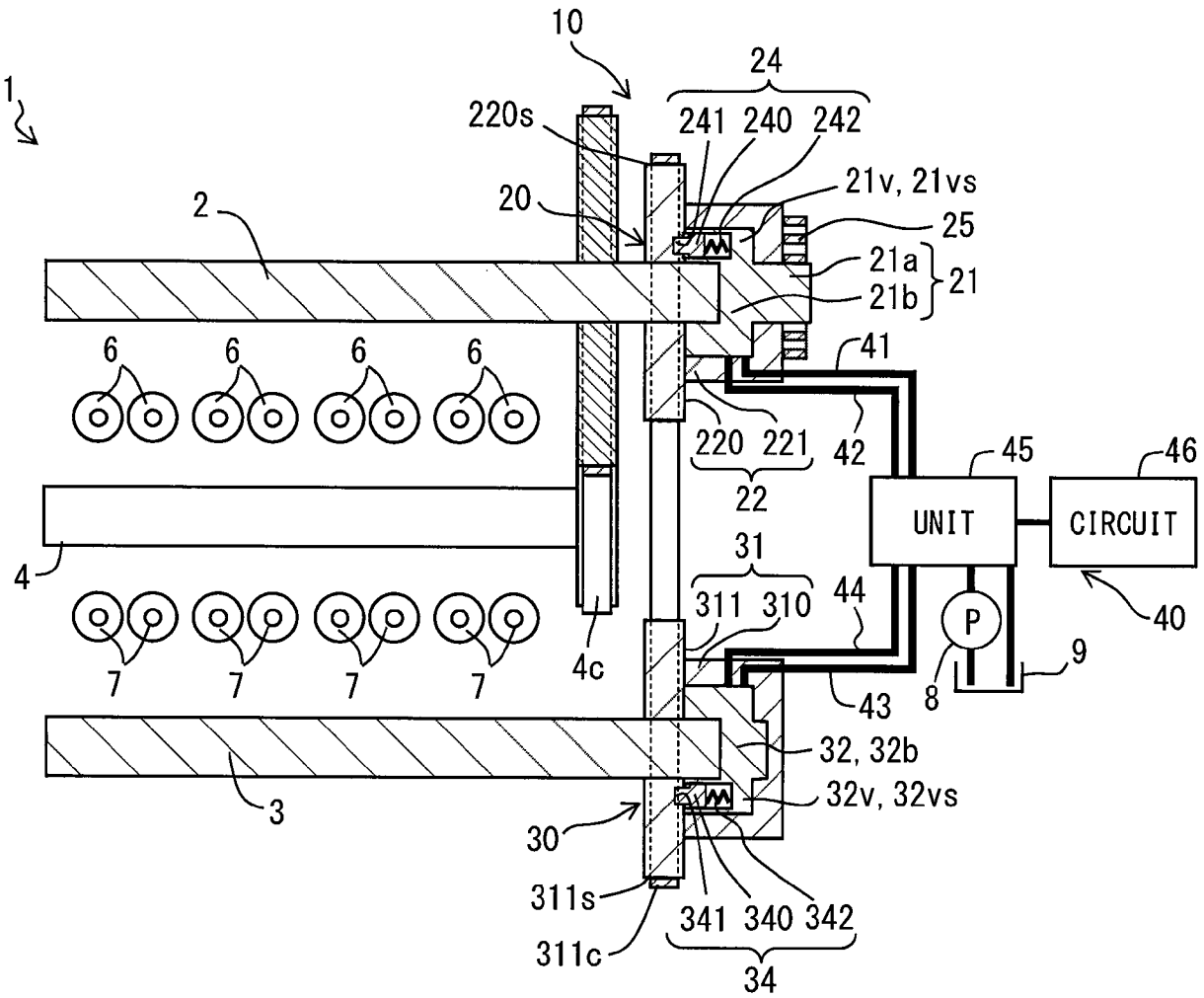
FIG. 25 is a configuration diagram according to another modification to the first embodiment as shown in FIG. 1.

As shown in FIG. 24, in a fourth modification to the fourth embodiment, the link rotors 3021 and 4021 may have gears 3211*g* and 4211*g* engaging each other. In this case, as shown in FIG. 24, although the exhaust sprocket 4211*s* and the exhaust link rotor 4021 are separately provided, the timing chain 4*c* may be wound between only the exhaust sprocket

4211*s* and the crank shaft 4, and the forward sprocket 3211*s* may be omitted. Further, the timing chain 4*c* may be wound between only the forward sprocket 3211*s* and the crank shaft 4, as with the configuration shown in FIG. 23, without the exhaust sprocket 4211*s*.

In a fifth modification to the first and fourth embodiments, the units 20, 30, 2020, 2030, 3020 and 4020, which adjust either one of the forward phase, the backward phase or the exhaust cam phase using a rotational torque electrically generated from, for example, an electric motor or an electromagnetic brake, may be used. Further, in a sixth modification to the second embodiment, the forward biasing member 2025 may be omitted.

In a seventh modification to the first to second embodiments, the forward link rotor 21 may be connected to the end side of the exhaust cam shaft 2 on the same side in the axial direction on which the timing chain 4*c* is wound. In an eighth modification to the third and fourth embodiments, the forward phase adjustment unit 3020, 4020 may have the forward biasing member 2025 of the second embodiment instead of the forward biasing member 25, and the backward phase adjustment unit may have the backward biasing member 2035 of the second embodiment. In this case, the forward phase locking at the forward-most retarded phase Pru may be achieved by the forward locking mechanism 3024 as modified according to the forward locking mechanism 2024 of the second embodiment. Along with this, the backward phase locking at the backward-most advanced phase Pad may be achieved by the backward locking mechanism 34 as modified according to the backward locking mechanism 2034 of the second embodiment.

In a ninth modification to the first, third and fourth embodiments, a configuration, which does not bring one or two of the backward failure state, the forward failure state and the forward-and-backward failure state by not producing one or two of the operational states (1 B), (1C) and (1D), may be used. Further, in a tenth modification to the second embodiment, a configuration, which does not bring one or two of the backward failure state, the forward failure state and the forward-and-backward failure state by not producing one or two of the operational states (2B), (2C) and (2D), may be used.

In an eleventh modification to the first to fourth embodiments, a configuration, which does not execute the locking of at least of one of the forward phase, the backward phase and the exhaust cam phase at the normal stop of the engine, may be used. Furthermore, in a twelfth modification to the first to fourth embodiments, a configuration, which does not execute the locking of at least one of the forward phase, the backward phase and the exhaust cam phase at the normal operation of the engine, may be used.

What is claimed is:

1. A valve control apparatus for adjusting valve timing of an internal combustion engine, the engine having an intake valve that is opened and closed by a rotation of an intake cam shaft, and an exhaust valve that is opened and closed by a rotation of an exhaust cam shaft that receives a crank torque from a crank shaft, the valve control apparatus comprising:

a forward phase adjustment unit that has a forward intermediate rotor rotatable relative to the exhaust cam shaft, the forward phase adjustment unit adjusting a forward phase that is a rotational phase of the forward intermediate rotor relative to the crank shaft; and a backward phase adjustment unit that has a backward intermediate rotor rotatable relative to the intake cam shaft and rotating in association with the forward intermediate rotor, the backward phase adjustment unit adjusting a backward phase that is a rotational phase of the intake cam shaft relative to the backward intermediate rotor, wherein the forward phase adjustment unit includes a forward stopper mechanism that prevents further advance of the forward phase by engaging the forward intermediate rotor at a forward-most advanced phase, which is a furthest-most advanced phase of the forward phase, a forward locking mechanism that locks the forward phase when reaching the forward-most advanced phase at a start time of the engine, and a forward biasing member that biases the forward intermediate rotor in an advance direction, wherein the backward phase adjustment unit receiving a cam torque from the intake cam shaft that is biased on average in a retard direction, the backward phase adjustment unit includes a backward stopper mechanism that prevents further retard of the backward phase by engaging the intake cam shaft at a backward-most retarded phase, which is a furthest-most retarded phase of the backward phase, and a backward locking mechanism that locks the backward phase when reaching the backward-most retarded phase at the start time of the engine.

2. The valve control apparatus according to claim 1, wherein hydraulic fluid is supplied from a supply source of the engine, the forward phase adjustment unit further includes a forward link rotor that is rotatable relative to the forward intermediate rotor by pressure of the hydraulic fluid and is rotated together with the exhaust cam shaft in association with the crank shaft, the forward phase of the forward intermediate rotor is adjusted relative to the crank shaft according to a rotation of the forward intermediate rotor relative to the forward link rotor, the backward phase adjustment unit further includes a backward link rotor that is rotatable relative to the backward intermediate rotor by pressure of the hydraulic fluid and is rotated in association with the intake cam shaft, which is integrally formed with the backward link rotor, and the backward phase of the intake cam shaft is adjusted relative to the backward intermediate rotor according to a rotation of the backward link rotor relative to the backward intermediate rotor.

3. The valve control apparatus according to claim 2, wherein the supply source starts supplying the hydraulic fluid at the start time of the engine.

4. The valve control apparatus according to claim 1, wherein hydraulic fluid is supplied from a supply source of the engine, the forward phase adjustment unit further includes a forward link rotor that is rotatable relative to the forward intermediate rotor by pressure of the hydraulic fluid and is rotated in association with the crank shaft and an exhaust link rotor that is rotatable relative to the exhaust cam shaft, which is separately formed from the exhaust link rotor, by pressure of the hydraulic fluid and is rotated together with the forward link rotor in association with the crank shaft, the forward phase of the forward intermediate rotor is adjusted relative to the crank shaft according to a rotation of the forward intermediate rotor relative to the forward link rotor, an exhaust cam phase, which is a rotational phase of the exhaust cam shaft relative to the crank shaft, is adjusted according to a rotation of the exhaust cam shaft relative to the exhaust link rotor, the backward phase adjustment unit further includes a backward link rotor that is rotatable relative to the backward intermediate rotor by pressure of the hydraulic fluid and is rotated in association with the intake cam shaft, which is integrally formed with the backward link rotor, and the backward phase of the intake cam shaft is adjusted relative to the backward intermediate rotor according to a rotation of the backward link rotor relative to the backward intermediate rotor.

5. A valve control apparatus for adjusting valve timing of an internal combustion engine, the engine having an intake valve that is opened and closed by a rotation of an intake cam shaft, and an exhaust valve that is opened and closed by a rotation of an exhaust cam shaft that receives a crank torque from a crank shaft, the valve control apparatus comprising:

a forward phase adjustment unit that has a forward intermediate rotor rotatable relative to the exhaust cam shaft, the forward phase adjustment unit adjusting a forward phase that is a rotational phase of the forward intermediate rotor relative to the exhaust cam shaft; and a backward phase adjustment unit that has a backward intermediate rotor rotatable relative to the intake cam shaft and rotating in association with the forward intermediate rotor, the backward phase adjustment unit adjusting a backward phase that is a rotational phase of the intake cam shaft relative to the backward intermediate rotor, wherein the forward phase adjustment unit includes a forward stopper mechanism that prevents further retard of the forward phase by engaging the forward intermediate rotor at a forward-most retarded phase, which is a furthest-most retarded phase of the forward phase, and a forward locking mechanism that locks the forward phase when reaching the forward-most retarded phase at a start time of the engine, wherein the backward phase adjustment unit receiving a cam torque from the intake cam shaft that is biased on average in a retard direction, the backward phase adjustment unit includes a backward stopper mechanism that prevents further advance of the backward phase by engaging the intake cam shaft at a backward-most advanced phase, which is a furthest-most advanced phase of the backward phase, a backward locking mechanism that locks the backward phase when reaching the backward-most advanced phase at the start time of the engine, and a backward biasing member that biases the intake cam shaft in an advance direction and the backward intermediate rotor in the retard direction.

6. The valve control apparatus according to claim 5, wherein the forward phase adjustment unit further includes a forward biasing member that biases the forward intermediate rotor in the retard direction.

7. The valve control apparatus according to claim 5, wherein hydraulic fluid is supplied from a supply source of the engine, the forward phase adjustment unit further includes a forward link rotor that is rotatable relative to the forward intermediate rotor by pressure of the hydraulic fluid and is rotated together with the exhaust cam shaft in association with the crank shaft, the forward phase of the forward intermediate rotor is adjusted relative to the crank shaft according to a rotation of the forward intermediate rotor relative to the forward link rotor, the backward phase adjustment unit further includes a backward link rotor that is rotatable relative to the backward intermediate rotor by pressure of the hydraulic fluid and is rotated in association with the intake cam shaft, which is integrally formed with the backward link rotor, and the backward phase of the intake cam shaft is adjusted relative to the backward intermediate rotor according to a rotation of the backward link rotor relative to the backward intermediate rotor.

8. The valve control apparatus according to claim 5, wherein hydraulic fluid is supplied from a supply source of the engine, the forward phase adjustment unit further includes a forward link rotor that is rotatable relative to the forward intermediate rotor by pressure of the hydraulic fluid and is rotated in association with the crank shaft and an exhaust link rotor that is rotatable relative to the exhaust cam shaft, which is separately formed from the exhaust link rotor, by pressure of the hydraulic fluid and is rotated together with the forward link rotor in association with the crank shaft, the forward phase of the forward intermediate rotor is adjusted relative to the crank shaft according to a rotation of the forward intermediate rotor relative to the forward link rotor, an exhaust cam phase, which is a rotational phase of the exhaust cam shaft relative to the crank shaft, is adjusted according to a rotation of the exhaust cam shaft relative to the exhaust link rotor, the backward phase adjustment unit further includes a backward link rotor that is rotatable relative to the backward intermediate rotor by pressure of the hydraulic fluid and is rotated in association with the intake cam shaft, which is integrally formed with the backward link rotor, and the backward phase of the intake cam shaft is adjusted relative to the backward intermediate rotor according to a rotation of the backward link rotor relative to the backward intermediate rotor.

* * * * *